US008230924B2

(12) United States Patent
Clem et al.

(10) Patent No.: US 8,230,924 B2
(45) Date of Patent: Jul. 31, 2012

(54) FRACTURING AND GRAVEL PACKING TOOL WITH UPPER ANNULUS ISOLATION IN A REVERSE POSITION WITHOUT CLOSING A WASH PIPE VALVE

(75) Inventors: Nicholas J. Clem, Houston, TX (US); Martin P. Coronado, Cypress, TX (US); Jeffery D. Kitzman, Conroe, TX (US); Jeffry S. Edwards, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 448 days.

(21) Appl. No.: 12/553,429

(22) Filed: Sep. 3, 2009

(65) Prior Publication Data

US 2011/0048704 A1 Mar. 3, 2011

(51) Int. Cl.
*E21B 43/04* (2006.01)

(52) U.S. Cl. ..... 166/278; 166/51

(58) Field of Classification Search ..... 166/278, 166/51, 158, 373
See application file for complete search history.

(56) References Cited

U.S. PATENT DOCUMENTS

| | | | | |
|---|---|---|---|---|
| 3,986,554 | A | 10/1976 | Nutter | |
| 4,452,313 | A | 6/1984 | McMahan | |
| 4,880,056 | A | 11/1989 | Nelson et al. | |
| 5,137,088 | A | 8/1992 | Farley et al. | |
| 5,609,178 | A | 3/1997 | Hennig et al. | |
| 5,609,204 | A | 3/1997 | Rebardi et al. | |
| 5,865,251 | A | 2/1999 | Rebardi et al. | |
| 6,053,246 | A | 4/2000 | Echols et al. | |
| 6,079,496 | A | 6/2000 | Hirth | |
| 6,230,801 | B1 | 5/2001 | Hill, Jr. et al. | |
| 6,382,319 | B1 | 5/2002 | Hill, Jr. et al. | |
| 6,702,020 | B2 | 3/2004 | Zachman et al. | |
| 7,128,151 | B2 | 10/2006 | Corbett | |
| 7,971,642 | B2 * | 7/2011 | Yeh et al. | 166/278 |
| 8,056,628 | B2 * | 11/2011 | Whitsitt et al. | 166/278 |
| 2002/0096328 | A1 | 7/2002 | Echols et al. | |
| 2002/0195253 | A1 | 12/2002 | Hill, Jr. et al. | |
| 2004/0069489 | A1 | 4/2004 | Corbett | |
| 2005/0252660 | A1 | 11/2005 | Hughes et al. | |
| 2006/0225878 | A1 | 10/2006 | Coronado | |
| 2008/0099194 | A1 | 5/2008 | Clem | |
| 2009/0025923 | A1 | 1/2009 | Patel et al. | |
| 2009/0065193 | A1 | 3/2009 | Corbett | |
| 2009/0173503 | A1 | 7/2009 | Corbett et al. | |

FOREIGN PATENT DOCUMENTS

| | | |
|---|---|---|
| WO | 2009088621 | 7/2009 |

* cited by examiner

*Primary Examiner* — Kenneth L Thompson
(74) *Attorney, Agent, or Firm* — Steve Rosenblatt

(57) ABSTRACT

A fracturing and gravel packing tool has features that prevent well swabbing when the tool is picked up with respect to a set isolation packer. An upper or jet valve allows switching between the squeeze and circulation positions without risk of closing the wash pipe valve. The wash pipe valve can only be closed with multiple movements in opposed direction that occur after a predetermined force is held for a finite time to allow movement that arms the wash pipe valve. The jet valve can prevent fluid loss to the formation when being set down whether the crossover tool is supported on the packer or on the smart collet.

21 Claims, 35 Drawing Sheets

FRACTURING AND GRAVEL PACKING TOOL WITH UPPER ANNULUS ISOLATION IN A REVERSE POSITION WITHOUT CLOSING A WASH PIPE VALVE

FIELD OF THE INVENTION

The field of this invention relates to gravel packing and fracturing tools used to treat formations and to deposit gravel outside of screens for improved production flow through the screens.

BACKGROUND OF THE INVENTION

Completions whether in open or cased hole can involve isolation of the producing zone or zones and installing an assembly of screens suspended by an isolation packer. An inner string typically has a crossover tool that is shifted with respect to the packer to allow fracturing fluid pumped down the tubing string to get into the formation with no return path to the surface so that the treating fluid can go into the formation and fracture it or otherwise treat it. This closing of the return path can be done at the crossover or at the surface while leaving the crossover in the circulate position and just closing the annulus at the surface. The crossover tool also can be configured to allow gravel slurry to be pumped down the tubing to exit laterally below the set packer and pack the annular space outside the screens. The carrier fluid can go through the screens and into a wash pipe that is in fluid communication with the crossover tool so that the returning fluid crosses over through the packer into the upper annulus above the set packer.

Typically these assemblies have a flapper valve, ball valve, ball on seat or other valve device in the wash pipe to prevent fluid loss into the formation during certain operations such as reversing out excess gravel from the tubing string after the gravel packing operation is completed. Some schematic representations of known gravel packing systems are shown schematically in U.S. Pat. No. 7,128,151 and in more functional detail in U.S. Pat. No. 6,702,020. Other features of gravel packing systems are found in U.S. Pat. No. 6,230,801. Other patents and applications focus on the design of the crossover housing where there are erosion issues from moving slurry through ports or against housing walls on the way out such as shown in U.S. application Ser. Nos. 11/586,235 filed Oct. 25, 2006 and application Ser. No. 12/250,065 filed Oct. 13, 2008. Locator tools that use displacement of fluid as a time delay to reduce applied force to a bottom hole assembly before release to minimize a slingshot effect upon release are disclosed in US Publication 2006/0225878. Also relevant to time delays for ejecting balls off seats to reduce formation shock is U.S. Pat. No. 6,079,496. Crossover tools that allow a positive pressure to be put on the formation above hydrostatic are shown in US Publication 2002/0195253 Other gravel packing assemblies are found in U.S. Pat. Nos. 5,865,251; 6,053,246 and 5,609,204.

These known systems have design features that are addressed by the present invention. One issue is well swabbing when picking up the inner string. Swabbing is the condition of reducing formation pressure when lifting a tool assembly where other fluid cannot get into the space opened up when the string is picked up. As a result the formation experiences a drop in pressure. In the designs that used a flapper valve in the inner string wash pipe this happened all the time or some of the time depending on the design. If the flapper was not retained open with a sleeve then any movement uphole with the inner string while still sealed in the packer bore would swab the well. In designs that had retaining sleeves for the flapper held in position by a shear pin, many systems had the setting of that shear pin at a low enough value to be sure that the sleeve moved when it was needed to move that it was often inadvertently sheared to release the flapper. From that point on a pickup on the inner string would make the well swab. Some of the pickup distances were several feet so that the extent of the swabbing was significant.

The present invention provides an ability to shift between squeeze, circulate and reverse modes using the packer as a frame of reference where the movements between those positions do not engage the low bottom hole pressure control device or wash pipe valve for operation. In essence the wash pipe valve is held open and it takes a pattern of deliberate steps to get it to close. In essence a pickup force against a stop has to be applied for a finite time to displace fluid from a variable volume cavity through an orifice. It is only after holding a predetermined force for a predetermined time that the wash pipe valve assembly is armed by allowing collets to exit a bore. A pattern of passing through the bore in an opposed direction and then picking up to get the collets against the bore they just passed through in the opposite direction that gets the valve to close. Generally the valve is armed directly prior to gravel packing and closed after gravel packing when pulling the assembly out to prevent fluid losses into the formation while reversing out the gravel.

The extension ports can be closed with a sleeve that is initially locked open but is unlocked by a shifting tool on the wash pipe as it is being pulled up. The sleeve is then shifted over the ports in the outer extension and locked into position. This insures gravel from the pack does not return back thru the ports, and also restricts subsequent production to enter the production string only through the screens. For the run in position this same sleeve is used to prevent flow out the crossover ports so that a dropped ball can be pressurized to set the packer initially.

The upper valve assembly that indexes off the packer has the capability of allowing reconfiguration after normal operations between squeezing and circulation while holding the wash pipe valve open. The upper valve assembly also has the capability to isolate the formation against fluid loss when it is closed and the crossover is in the reverse position when supported off the reciprocating set down device. An optional ball seat can be provided in the upper valve assembly so that acid can be delivered though the wash pipe and around the initial ball dropped to set the packer so that as the wash pipe is being lifted out of the well acid can be pumped into the formation adjacent the screen sections as the lower end of the wash pipe moves past them.

These and other advantages of the present invention will be more apparent to those skilled in the art from a review of the detailed description of the preferred embodiment and the associated drawings that appear below with the understanding that the appended claims define the literal and equivalent scope of the invention.

SUMMARY OF THE INVENTION

A fracturing and gravel packing tool has features that prevent well swabbing when the tool is picked up with respect to a set isolation packer. An upper or multi-acting circulation valve allows switching between the squeeze and circulation positions without risk of closing the wash pipe valve. A metering device allows a surface indication before the wash pipe valve can be activated. The wash pipe valve can only be closed with multiple movements in opposed direction that occur after a predetermined force is held for a finite time to allow movement that arms the wash pipe valve. The multi-acting circulation valve can prevent fluid loss to the formation when closed and the crossover tool is located in the reverse position. A lockable sleeve initially blocks the gravel exit ports to allow the packer to be set with a dropped ball. The gravel exit ports are pulled out of the sleeve for later gravel packing. That sleeve is unlocked after gravel packing with a shifting tool on the wash pipe to close the gravel slurry exit ports and lock the sleeve in that position for production through the screens. The multi-acting circulation valve can be optionally configured for a second ball seat that can shift a sleeve to allow acid to be pumped through the wash pipe lower end and around the initial ball that was landed to set the packer. That series of movements also blocks off the return path so that the acid has to go to the wash pipe bottom.

DETAILED DESCRIPTION OF THE PREFERRED EMBODIMENT

Figures 1, 2, 3, 4, 5, 6, 7:
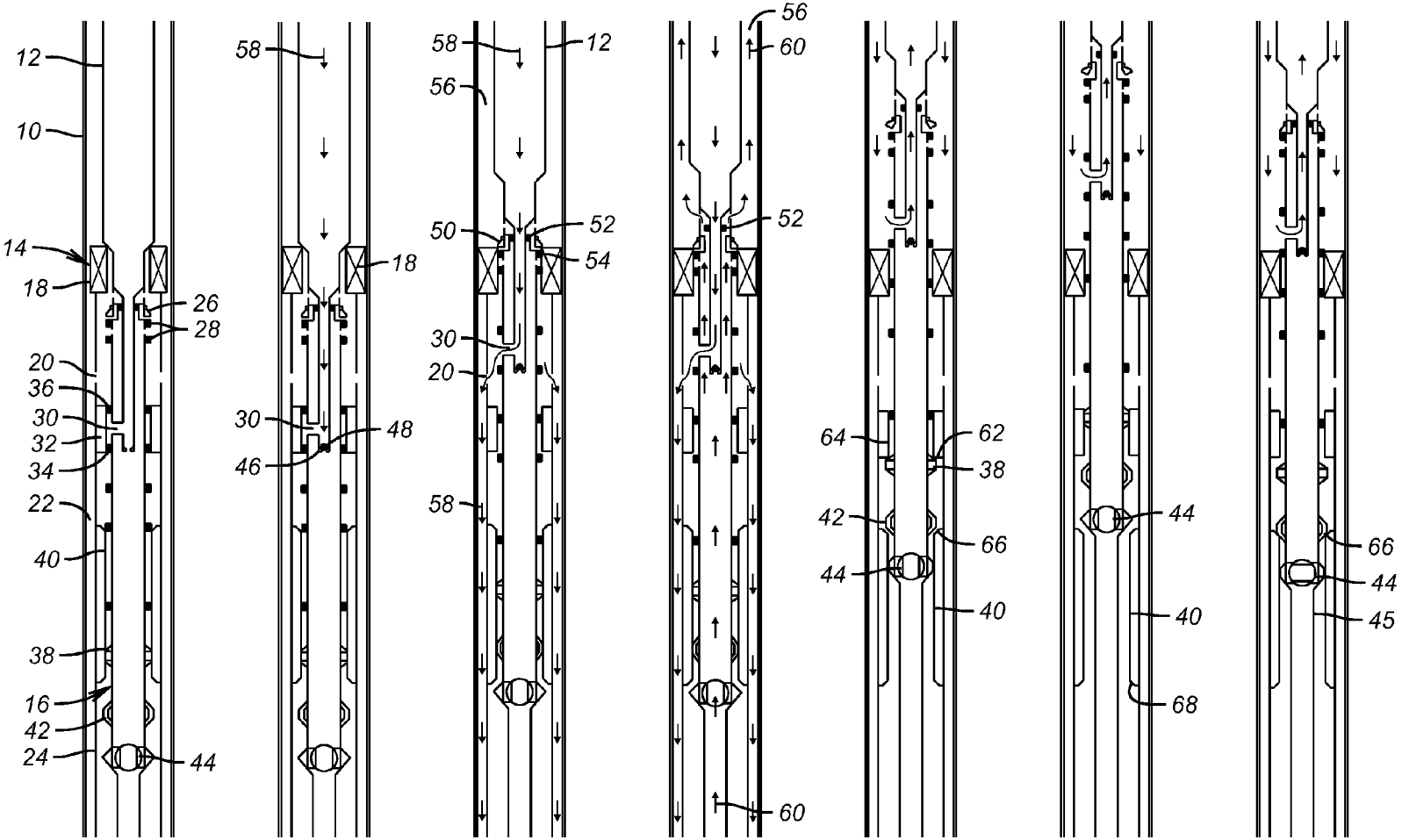
FIG. 1 is a system schematic representation to show the major components in the run in position.
FIG. 2 is the view of FIG. 1 in the packer set position.
FIG. 3 is the view of FIG. 2 in the squeeze position.
FIG. 4 is the view of FIG. 3 in the circulate position.
FIG. 5 is the view of FIG. 4 in the metering position which is also the reverse out position.
FIG. 6 shows how to arm the wash pipe valve so that a subsequent predetermined movement of the inner string can close the wash pipe valve.
FIG. 7 is similar to FIG. 5 but the wash pipe valve has been closed and the inner assembly is in position for pulling out of the hole for a production string and the screens below that are not shown.

Referring to FIG. 1, a wellbore 10 that can be cased or open hole has in it a work string 12 that delivers an outer assembly 14 and an inner string assembly 16. At the top of the outer assembly is the isolation packer 18 which is unset for run in FIG. 1. A plurality of fixed ports 20 allow gravel to exit into the annulus 22 as shown in FIG. 4 in the circulation position. A tubular string 24 continues to a series of screens that are not shown at the lower ends of FIG. 1-7 but are of a type well known in the art. There may also be another packer below the screens to isolate the lower end of the zone to be produced or the zone in question may go to the hole bottom.

The inner string assembly 16 has a multi-passage or multi-acting circulation valve or ported valve assembly 26 that is located below the packer 18 for run in. Seals 28 are below the multi-acting circulation valve 26 to seal into the packer bore for the squeeze and circulate position shown in FIG. 3. Seals 28 are also below the packer bore during run in to maintain hydrostatic pressure on the formation prior to, and after setting, the packer.

Gravel exit ports 30 are held closed for run in against sleeve 32 and seals 34 and 36. Metering dogs 38 are shown initially in bore 40 while the reciprocating set down device 42 and the valve assembly 44 are supported below bore 40. Alternatively, the entire assembly of dogs 38, reciprocating set down device 42 and valve assembly 44 can be out of bore 40 for run in. Valve assembly 44 is locked open for run in. A ball seat 46 receives a ball 48, as shown in FIG. 2 for setting the packer 18.

When the packer 18 has been positioned in the proper location and is ready to be set, the ball 48 is pumped to seat 46 with ports 30 in the closed position, as previously described. The applied pressure translates components on a known packer setting tool and the packer 18 is now set in the FIG. 2 position. Arrows 48 represent the pressure being applied to the known packer setting tool (not shown) to get the packer 18 set.

In FIG. 3 the string 12 is raised and the collets 50 land on the packer 18. With weight set down on the string 12 seals 52 and 54 on the multi-acting circulation valve 26 isolates the upper annulus 56 from the annulus 22. Flow down the string 12 represented by arrows 58 enters ports 30 and then ports 20 to get to the annulus 22 so that gravel slurry represented by arrows 58 can fill the annulus 22 around the screens (not shown). The multi-acting circulation valve 26 has a j-slot mechanism which will be described below that allows the string 12 to be picked up and set down to get seal 52 past a port so as to open a return flow path that is shown in FIG. 4. It should be noted that picking up the string 12 allows access to the annulus 22 every time to avoid swabbing the formation by connecting it fluidly to the upper annulus 56. On the other hand, setting down on string 12 while the collets 50 rest on the packer 18 will close off the return path to the upper annulus 56 by virtue of seal 52 going back to the FIG. 3 position. This is accomplished with a j-slot mechanism that will be described below. In the circulation mode of FIG. 4 the return flow through the screens (not shown) is shown by arrows 60. The positions in FIGS. 3 and 4 can be sequentially obtained with a pickup and set down force using the j-slot assembly mentioned before.

In FIG. 5 the string 12 has been raised until the metering dogs 38 have landed against a shoulder 62. A pull of a predetermined force for a predetermined time will displace fluid through an orifice and ultimately allow the dogs 38 to collapse into or past bore 64 as shown in FIG. 6. Also, picking up to the FIG. 5 position lets the reciprocating set down device 42 come out of bore 40 so that it can land on shoulder 66 for selective support. Picking up the reciprocating set down device 42 off shoulder 66 and then setting it down again will allow the reciprocating set down device 42 to re-enter bore 40.

Once the valve assembly 44 is pulled past bore 40 as shown in FIG. 6 and returned back into bore 40 it is armed. Re-entering bore 40 then close the valve assembly 44. The valve assembly can re-enter bore 40 to go to the FIG. 7 position for coming out of the hole. It should be noted that reversing out can be done in the FIG. 5 or FIG. 7 positions. To reverse out in FIG. 5 position it is required that valve assembly 44 be closed to prevent fluid loss down the wash pipe 45, which is in effect a part of the inner string assembly 16 . Valve assembly 44 having been closed can be reopened by moving it through bore 40 and then landing it on shoulder 66.

Figure 8A:
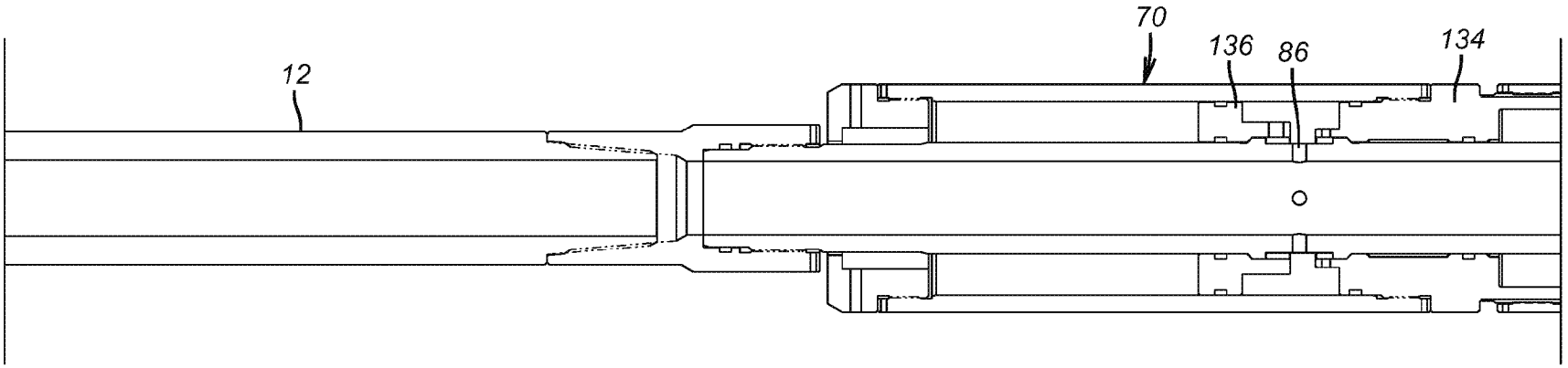
FIGS. 8*a-j* show the run in position of the assembly also shown in FIG. 1.

FIGS. 8*a*-8*j* represent the tool in the run in position. The major components will be described in an order from top to bottom to better explain how they operate. Thereafter, additional details and optional features will be described followed by the sequential operation that builds on the discussion provided with FIGS. 1-7. The work string 12 is shown in FIG. 8*a* as is the top of the packer setting tool 70 that is a known design. It creates relative movement by retaining the upper sub 72 and pushing down the packer setting sleeve 74 with its own sleeve 76. The upper sub 72 is held by the setting tool 70 using sleeve 78 that has flexible collets at its lower end supported for the setting by sleeve 80. After a high enough pressure to set the packer 18 has been applied in passage 82 and into ports 84, sleeve 80 is pushed up to undermine the fingers at the lower end of sleeve 78 so that the upper sub 72 is released by the setting tool 70. The initial buildup of pressure in passage 82 communicates through ports 86 in FIG. 8*a* to move the setting sleeve 76 of the setting tool 70 down against the packer setting sleeve 74 to set the packer 18 by pushing out the seal and slip assembly 88. It is worth noting that in the preferred embodiment the packer setting tool sets the packer at 4000 PSI through port 86. The pressure is then released and a pull is delivered to the packer with the work string to make sure the slips have set properly. At that point pressure is applied again. Sleeve 80 will move when 5000 PSI is applied.

Figure 8B:
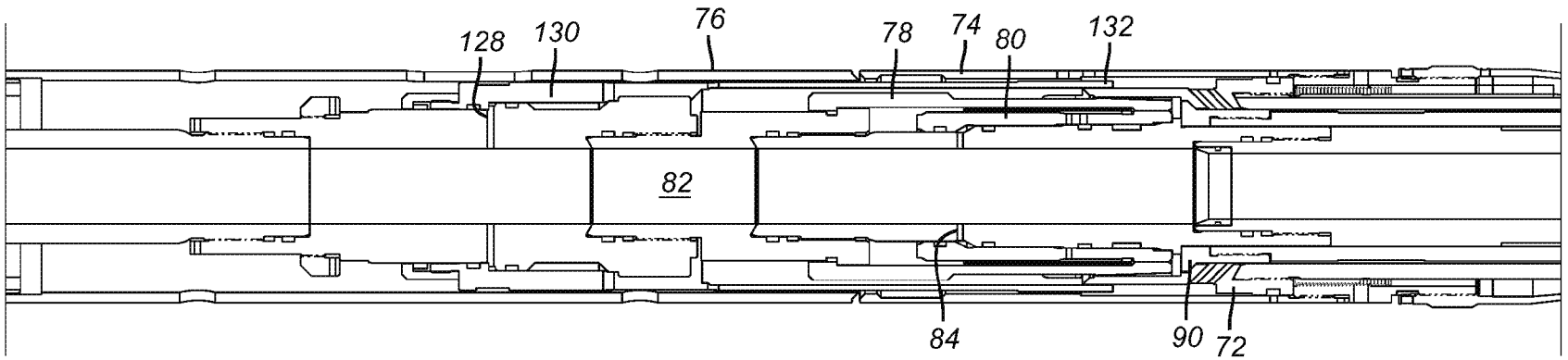
Figure 8C:
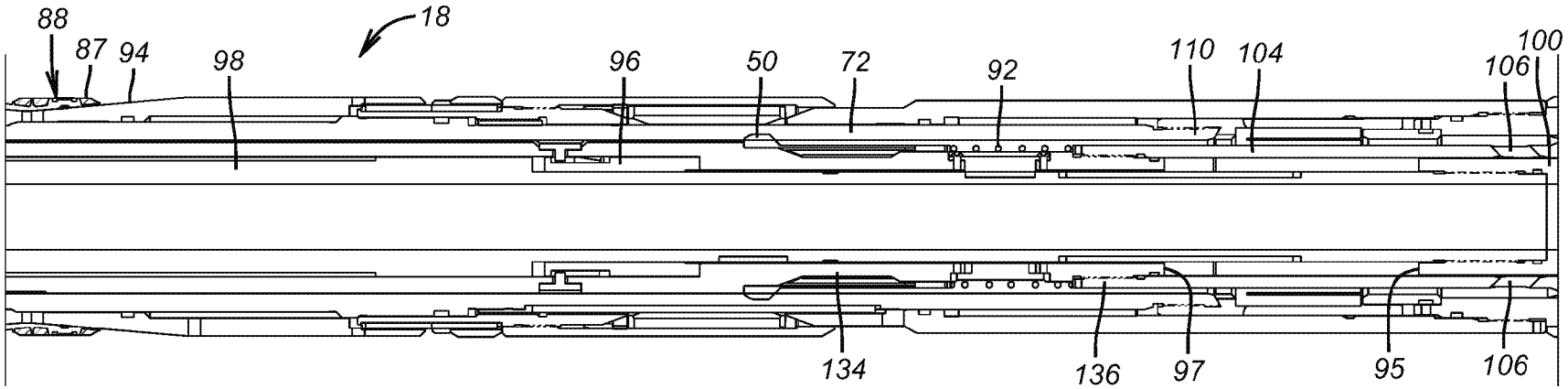
Figure 8D:
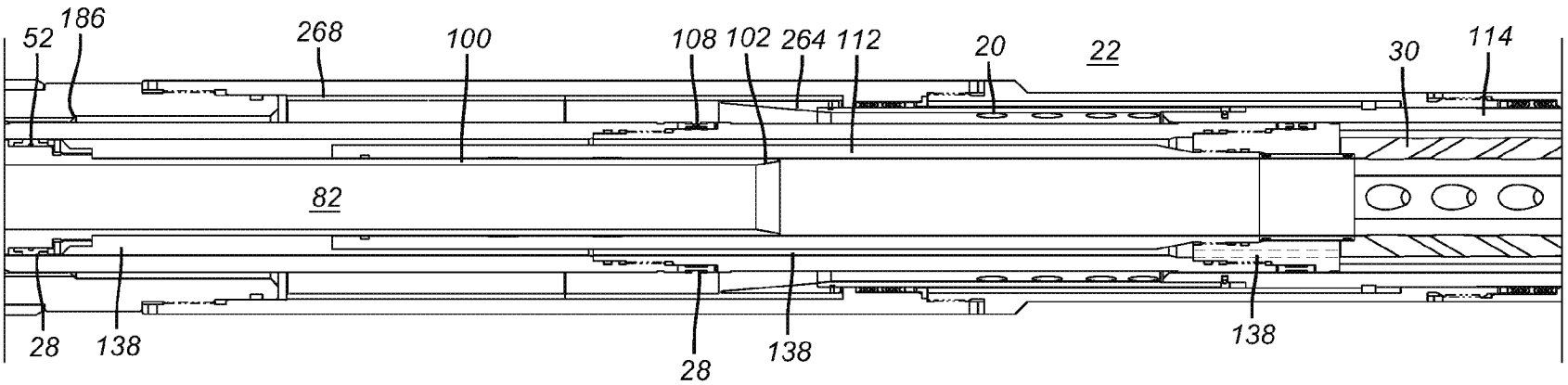
Figure 8E:
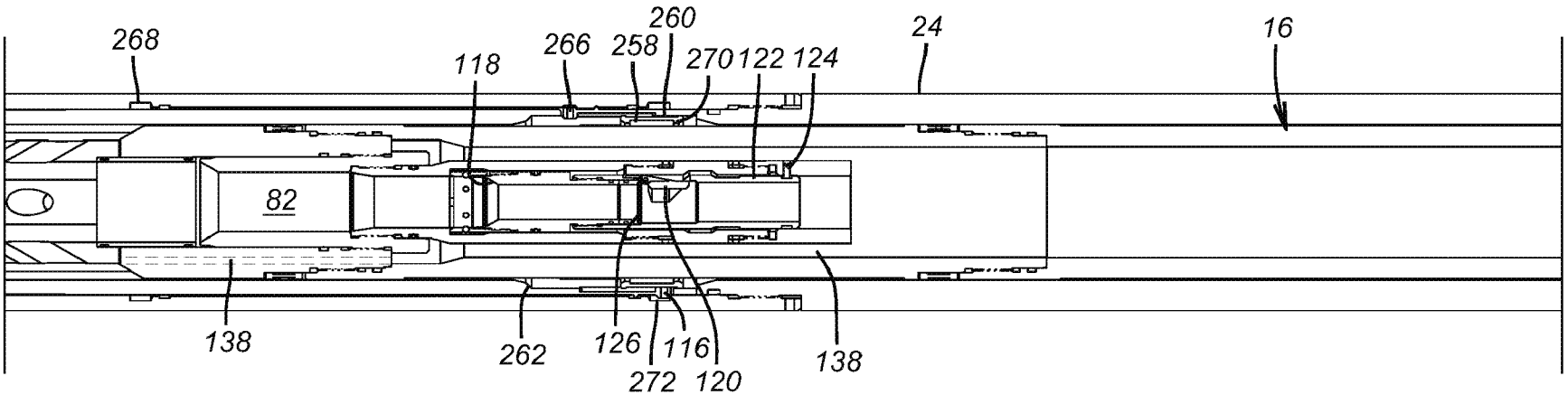

Continuing down on the outside of the packer 18 to FIG. 8*e* there are gravel slurry outlets 20 also shown in FIG. 1 which are a series of holes in axial rows that can be the same size or progressively larger in a downhole direction and they can be slant cut to be oriented in a downhole direction. These openings 20 have a clear shot into the lower annulus 22 shown in FIG. 1. One skilled in the art would understand that these axial rows of holes could be slots or windows of varying configuration so as to direct the slurry into the lower annulus 22. Continuing at FIG. 8*d* and below the string 24 continues to the screens that are not shown.

Referring now to FIGS. 8*b-d* the multi-acting circulation valve 26 will now be described. The top of the multi-acting circulation valve 26 is at 90 and rests on the packer upper sub 72 for run in. Spring loaded collets 50 shown extended in the squeeze position of FIG. 3, are held against the upper mandrel 94 by a spring 92. Upper mandrel 94 extends down from upper end 90 to a two position j-slot assembly 96. The j-slot assembly 96 operably connects the assembly of connected sleeves 98 and 100 to mandrel 94. Sleeve 100 terminates at a lower end 102 in FIG. 8*d*. Supported by mandrel 94 is ported sleeve 104 that has ports 106 through which flow represented by arrows 60 in FIG. 4 will pass in the circulation mode when seal 52 is lifted above ports 106. Below ports 106 is an external seal 28 that in the run in position is below the lower end 110 of the packer upper sub 72 and seen in FIG. 8*c*. Note also that sleeve 100 moves within sleeve 112 that has ports 30 covered for run in by sleeve 114 and locked by dog 116 in FIG. 8*e*. Ports 30 need to be covered so that after a ball is dropped onto seat 118 the passage 82 can be pressured up to set the packer 18.

A flapper valve 120 is held open by sleeve 122 that is pinned at 124. When the ball (first shown in corresponding FIG. 9) is landed on seat 118 and pressure in passage 82 is built up, the flapper is allowed to spring closed against seat 126 so that downhole pressure surges that might blow the ball (not shown in this view) off of seat 118 will be stopped.

Going back to FIGS. 8*a-b*, when pressure builds on passage 82 it will go through ports 128 and lift sleeve 130. The lower end of sleeve 130 serves as a rotational lock to the packer body or upper sub 72 during run in so that if the screens get stuck during run in they can be rotated to free them. After the proper placement for the packer 18 is obtained, the rotational lock of item 130 is no longer needed and it is forced up to release by pressure in passage 82 after the ball is dropped. Piston 134 is then pushed down to set the packer 18 and then piston 136 can move to prevent overstressing the packer seal and slip assembly 88 during the setting process. This creates a "soft release" so that the collet can unlatch from the packer top sub. The setting tool 70 is now released from the packer upper sub 72 and the string 12 can be manipulated.

Coming back to FIGS. 8*b-c*, with the packer 18 set, the top 90 of the multi-acting circulation valve 26 can be raised up by pulling up on sleeves 98 and 100 to raise mandrel 94 after shoulders 95 and 97 engage, which allows the lower inner string to be raised. Ultimately the collets 50 will spring out at the location where top end 90 is located in FIG. 8*b*. With mandrel 94 and everything that hangs on it including sleeve 104, supported off the packer upper sub 72 the assembly of connected sleeves 98 and 100 can be manipulated up and down and in conjunction with j-slot 96 can come to rest at two possible locations after a pickup and a set down force of a finite length. In one of the two positions of the j-slot 96 the seal 52 will be below the ports 106 as shown in FIG. 8*c*. In the other position of the j-slot 96 the seal 52 will move up above the ports 106. In essence seal 52 is in the return flow path represented by arrows 60 in FIG. 4 in the circulate mode which happens when seal 52 is above ports 106 and the squeeze position where the return path to the upper annulus 56 is closed as in FIG. 3 and in the run in position of FIG. 8*c*.

It should be noted that every time the assembly of sleeves 98 and 100 is picked up the seal 52 will rise above ports 106 and the formation will be open to the upper annulus 56. This is significant in that it prevents the formation from swabbing as the inner string assembly 16 is picked up. If there are seals around the inner string assembly 16 when it is raised for any function, the raising of the inner string assembly 16 will reduce pressure in the formation or cause swabbing which is detrimental to the formation. As mentioned before moving up to operate the j-slot 96 or lifting the inner string to the reverse position of FIG. 5 or 7 will not actuate the valve assembly 44 nor will it swab the formation. The components of the multi-acting circulation valve have now been described; however there is an optional construction where the return path 137 shown above ports 106 in FIG. 8*c* is different. The purpose of this alternative embodiment is to allow pumping fluid down passage 82 as the inner string assembly 16 is removed and to block paths of least resistance so that fluid pumped down passage 82 will go down to the lower end of the inner string assembly 16 past the open valve assembly 44 for the purpose of treating from within the screens with acid as the lower end of the inner string assembly 16 moves up the formation on the way out of the wellbore.

Figure 9A:
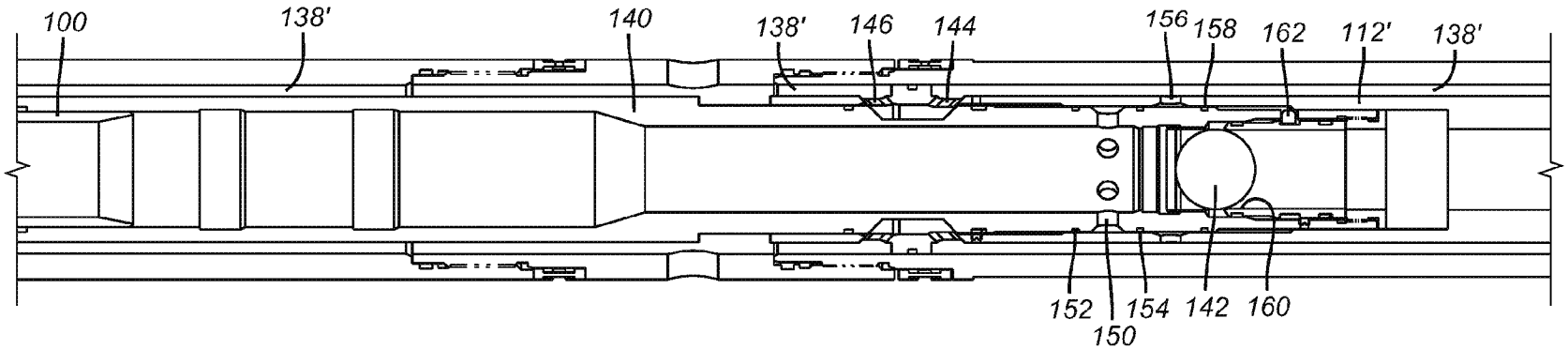
FIGS. 9*a-b* the optional additional ball seat in the multi-acting circulation valve before and after dropping the ball to shift a ball seat to allow acidizing after gravel packing on the way out of the hole.
Figure 9B:
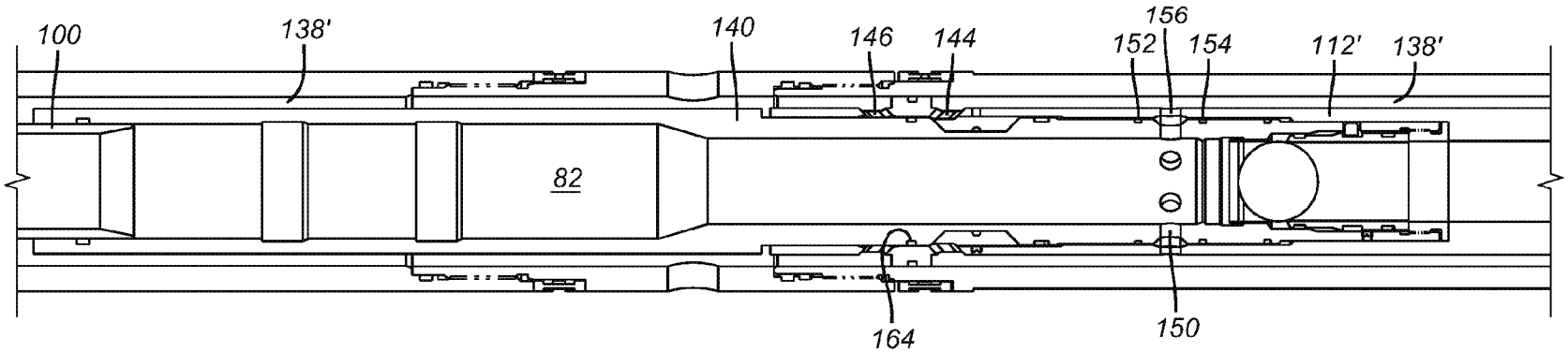

First to gain additional perspective, it is worth noting that the return path 138 around the flapper 120 in FIG. 8*e* starts below the ports 30 and bypasses them as shown by the paths in hidden lines and then continues in the run in position until closed off at seal 52 just below the ports 106 in FIG. 8*c*. Referring now to FIG. 9*a* part 112' has been redesigned and part 140 is added to span between parts 100 that is inside part 140 at the top and part 112' that surrounds it at the bottom. Note that what is shown in FIGS. 9*a-b* is well above the ball seat 118 that was used to set the packer 18 and that is shown in FIG. 8*e*. Even with this optional design for the multi-acting circulation valve 26 it should be stated that the ball 142 is not dropped until after the gravel packing and reversing out steps are done and the inner string assembly 16 is ready to be pulled out. Note that return path 138' is still there but now it passes through part 112' at ports 144 and 146 and channel 138' on the exterior of part 140. Ports 150 are held closed by seals 152 and 154. Ports 156 are offset from ports 150 and are isolated by seals 154 and 158. Ball 142 lands on seat 160 held by dog 162 to part 140. When ball 142 lands on seat 160 and pressure builds to undermine dogs 162 so that part 140 can shift down to align ports 150 and 156 between seals 152 and 154 while isolating ports 144 from ports 146 with seal 164. Now acid pumped down passage 82 cannot go uphole into return path 138' because seal 164 blocks it. It is fine for the acid to go downhole into passage 138' as by that time after the gravel packing the flow downhole into path 138' will simply go to the bottom of the inner string assembly 16 as it is pulled out of the whole, which is the intended purpose anyway which is to acidize as the inner string is pulled out of the hole.

Figure 8F:
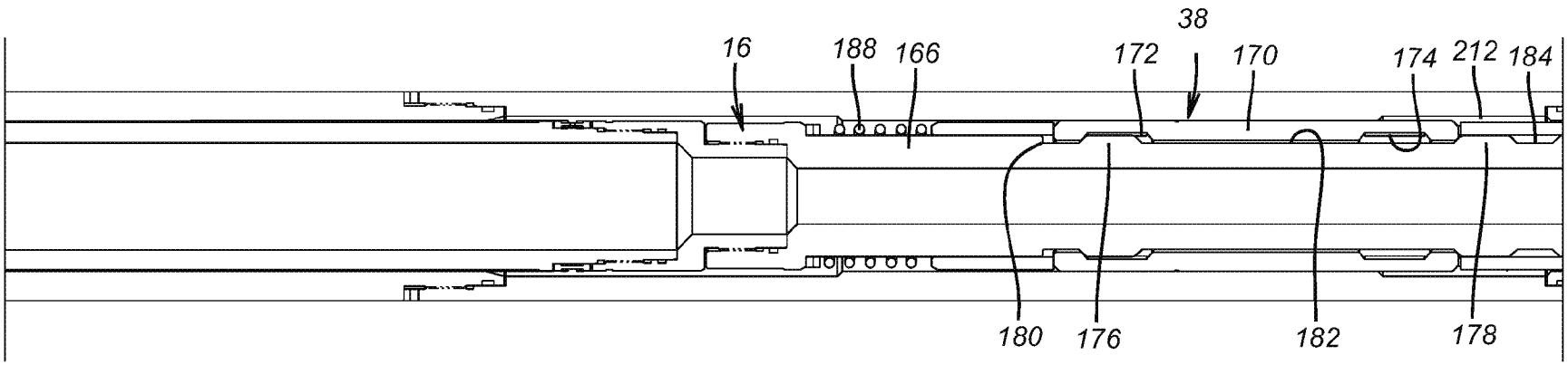
Figure 8G:
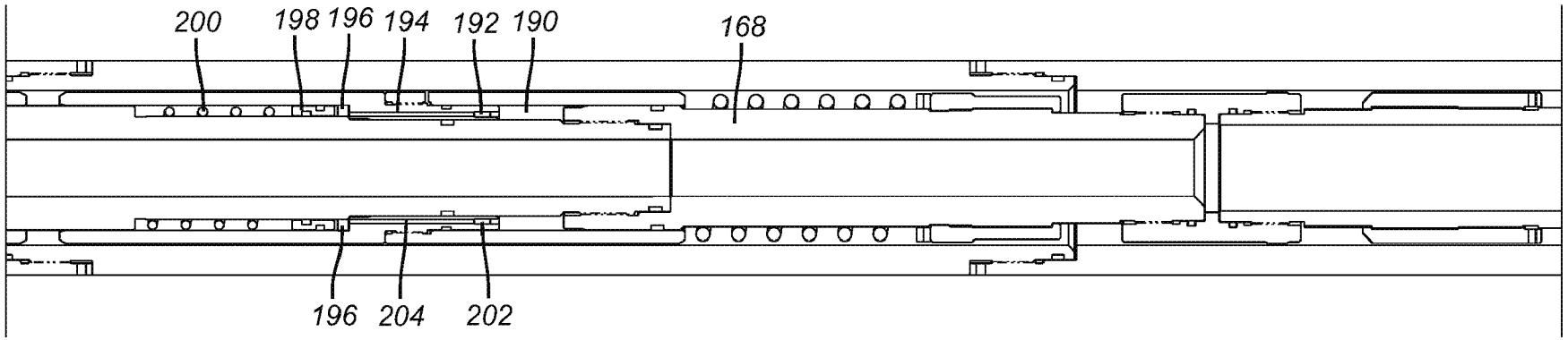
Figure 8H:
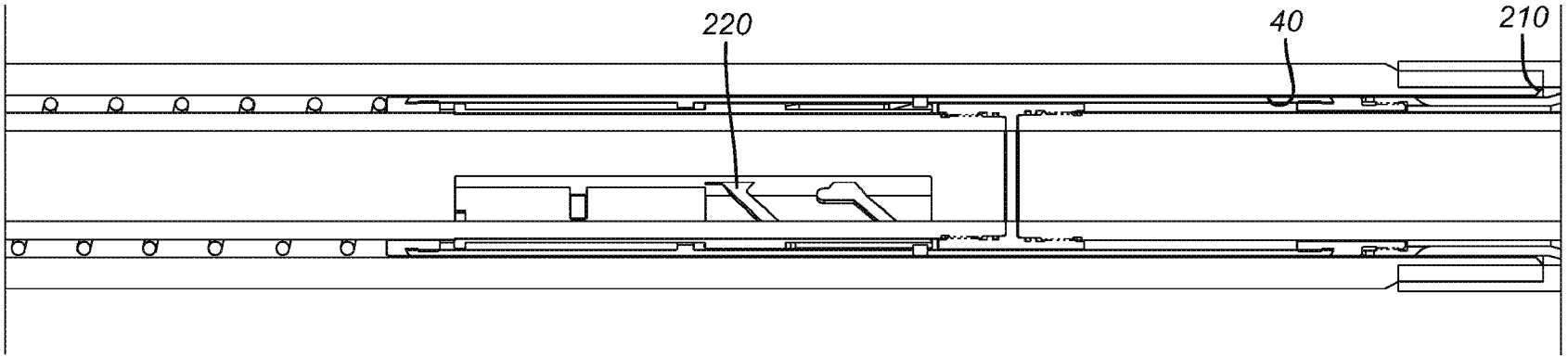

Referring now to FIGS. 8*e-g* the inner string assembly 16 continues with metering device top mandrel 166 that continues to the metering device lower mandrel 168 in FIG. 8*g*. The metering assembly 38 is shown in FIGS. 1-7. It comprises a series of dogs 170 that have internal grooves 172 and 174 near opposed ends. Metering sub 166 has humps 176 and 178 initially offset for run in from grooves 172 and 174 but at the same spacing. Humps 176 and 178 define a series of grooves 180, 182 and 184. For run in the dogs 170 are radially retracted into grooves 180 and 182. When the inner string assembly 16 is picked up, the dogs 170 continue moving up without interference until hitting shoulder 186 in FIG. 8*d*. Before that point is reached, however, the dogs 170 go into a bigger bore than the run in position of FIG. 8*f* and that is when spring 188 pushes the dogs 170 down relative to the metering sub 166 to hold the dogs 170 in the radially extended position up on humps 176 and 178 before the travel stop shoulder 186 is engaged by dogs 170. In order for the metering sub to keep moving up after the dogs 170 shoulder out it has to bring with it lower mandrel 168 and that requires reducing the volume of chamber 190 which is oil filled by driving the oil through orifice 192 and passage 194 to chamber 196. Piston 198 is biased by spring 200 and allows piston 198 to shift to compensate for thermal effects. It takes time to do this and this serves as a surface signal that if the force is maintained on the inner string assembly 16 that valve assembly 44 will be armed as shown in FIG. 6. If the orifice 192 is plugged, a higher force can be applied than what it normally takes to displace the oil from chamber 190 and a spring loaded safety valve 202 will open to passage 204 as an alternate path to chamber 196. When enough oil has been displaced, the inner string assembly 16 moves enough to allow the opposed ends of the dogs 170 to pop into grooves 182 and 184 to undermine support for the dogs 170 while letting the inner string assembly 16 advance up. The wash pipe valve assembly 44 is now expanded upon emerging from bore 40. It will take lowering it down through bore 40 below shoulder 210 to arm it and raising valve assembly 44 back into bore 40 to close it.

Pulling the metering sub 166 up after the dogs 170 are undermined brings the collets 257 (shown in FIG. 10*c*) on valve assembly 44 completely through narrow bore 40 that starts at 210 and ends at 212 in FIG. 8*g*. The collets 206 will need to go back through bore 40 from 212 to 210 and then the inner string assembly 16 will need to be picked up to get the collets 257 back into bore 40 for the valve assembly 44 to close. The valve will close when the collet 257 is drawn back into bore 40.

The reciprocating set down device 42 has an array of flexible fingers 214 that have a raised section 216 with a lower landing shoulder 218. There is a two position j-slot 220. In one position when the shoulder 218 is supported, the j-slot 220 allows lower reciprocating set down device mandrel 222 that is part of the inner string assembly 16 to advance until shoulder 224 engages shoulder 226, which shoulder 226 is now supported because the shoulder 218 has found support. Coincidentally with the shoulders 224 and 226 engaging, hump 228 comes into alignment with shoulder 218 to allow the reciprocating set down device 42 to be held in position off shoulder 218. This is shown in the metering and the reverse positions of FIGS. 5 and 7. However, picking up the inner string assembly 16 gets hump 228 above shoulder 218 and actuates the two position j-slot 220 so that when weight is again set down the hump 228 will not ride down to the shoulder 218 to support it so that the collet assembly 214, 216 will simple collapse inwardly if weight is set down on it and shoulder 218 engages a complementary surface such as 212 in FIG. 8*g*.

Figure 8I:
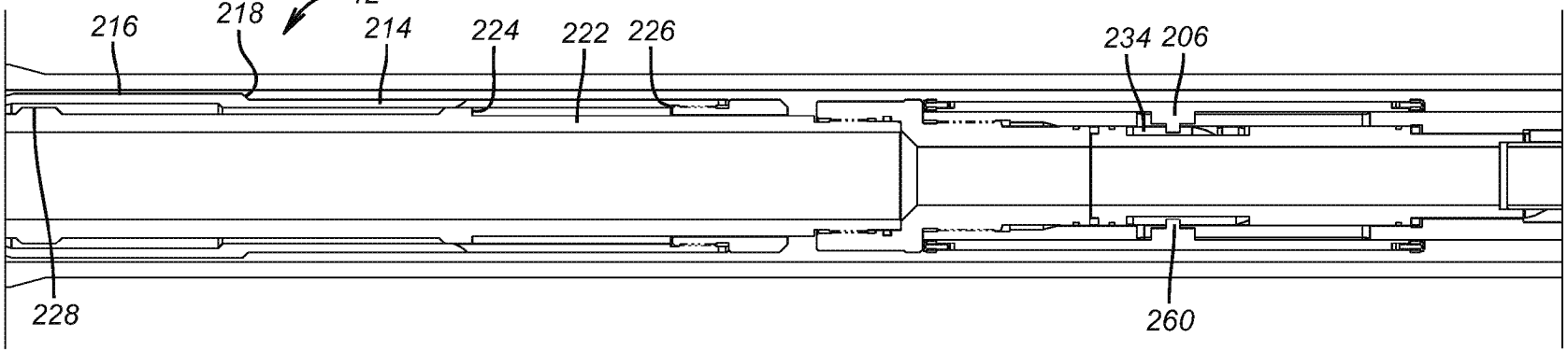
Figure 8J:
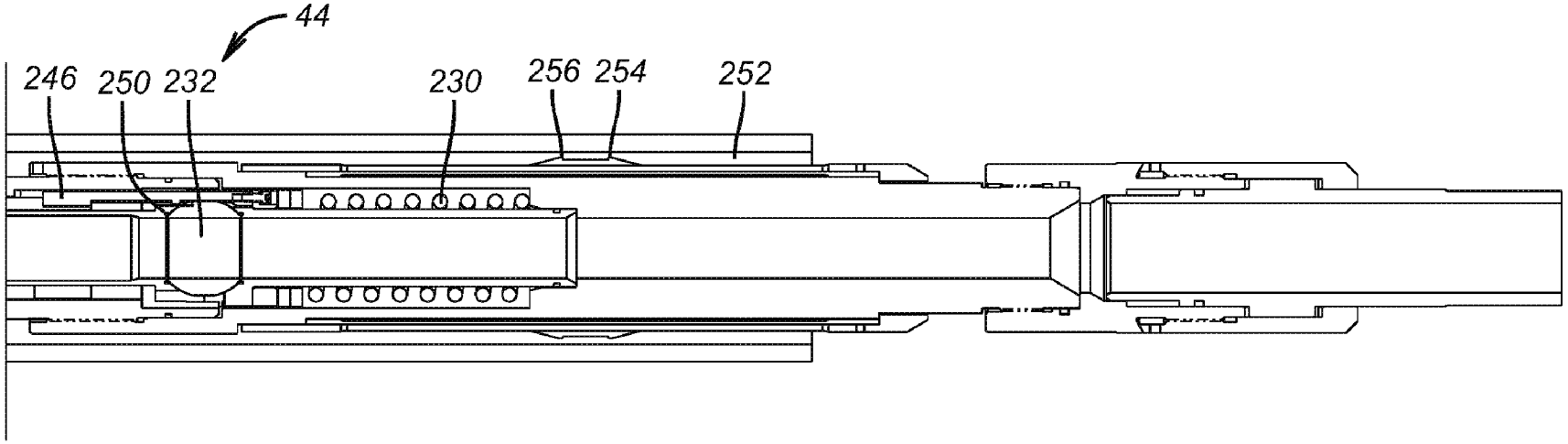
Figure 10A:
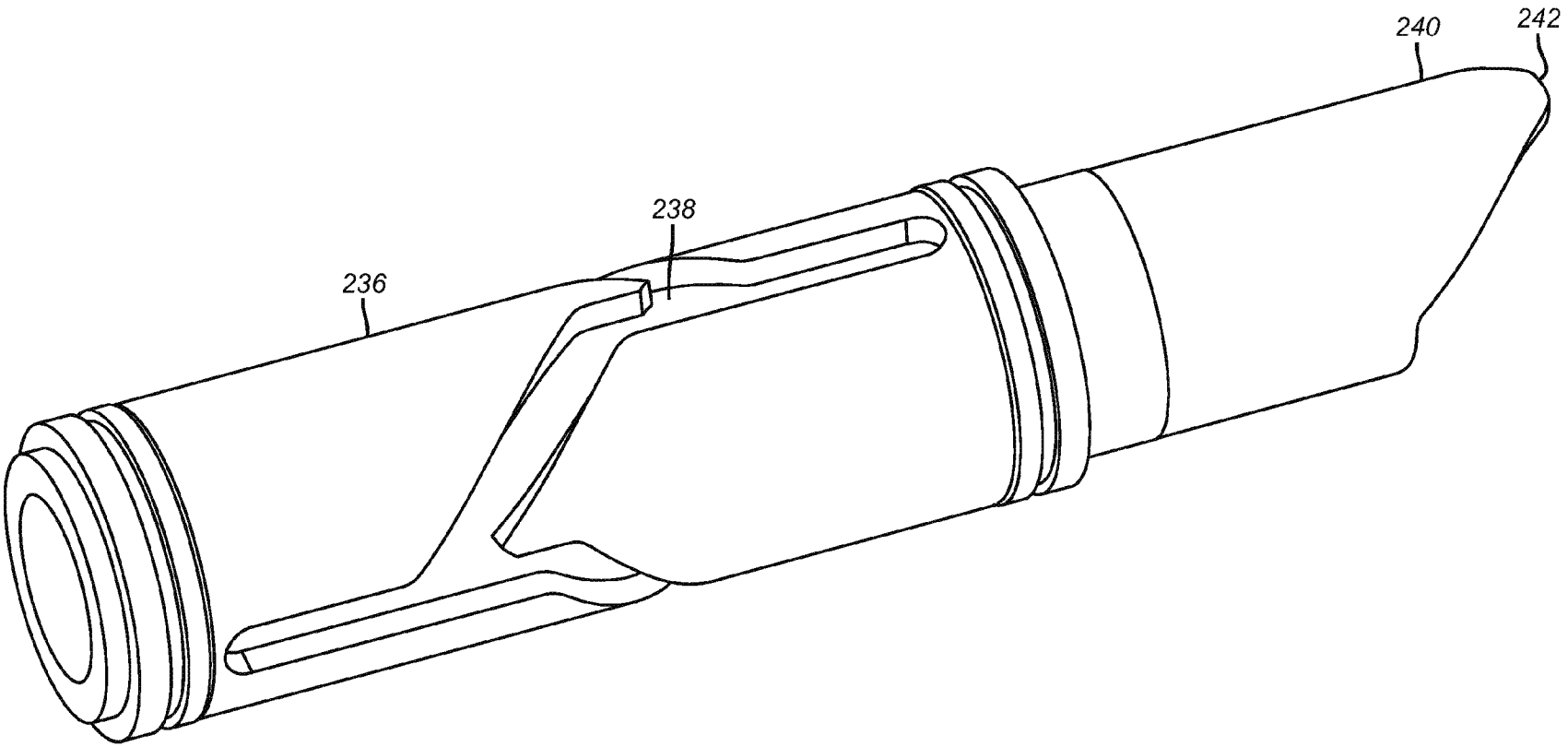
FIGS. 10*a-c* are isometric views of the low bottom hole pressure ball valve assembly that is located near the lower end of the inner string.
Figure 10B:
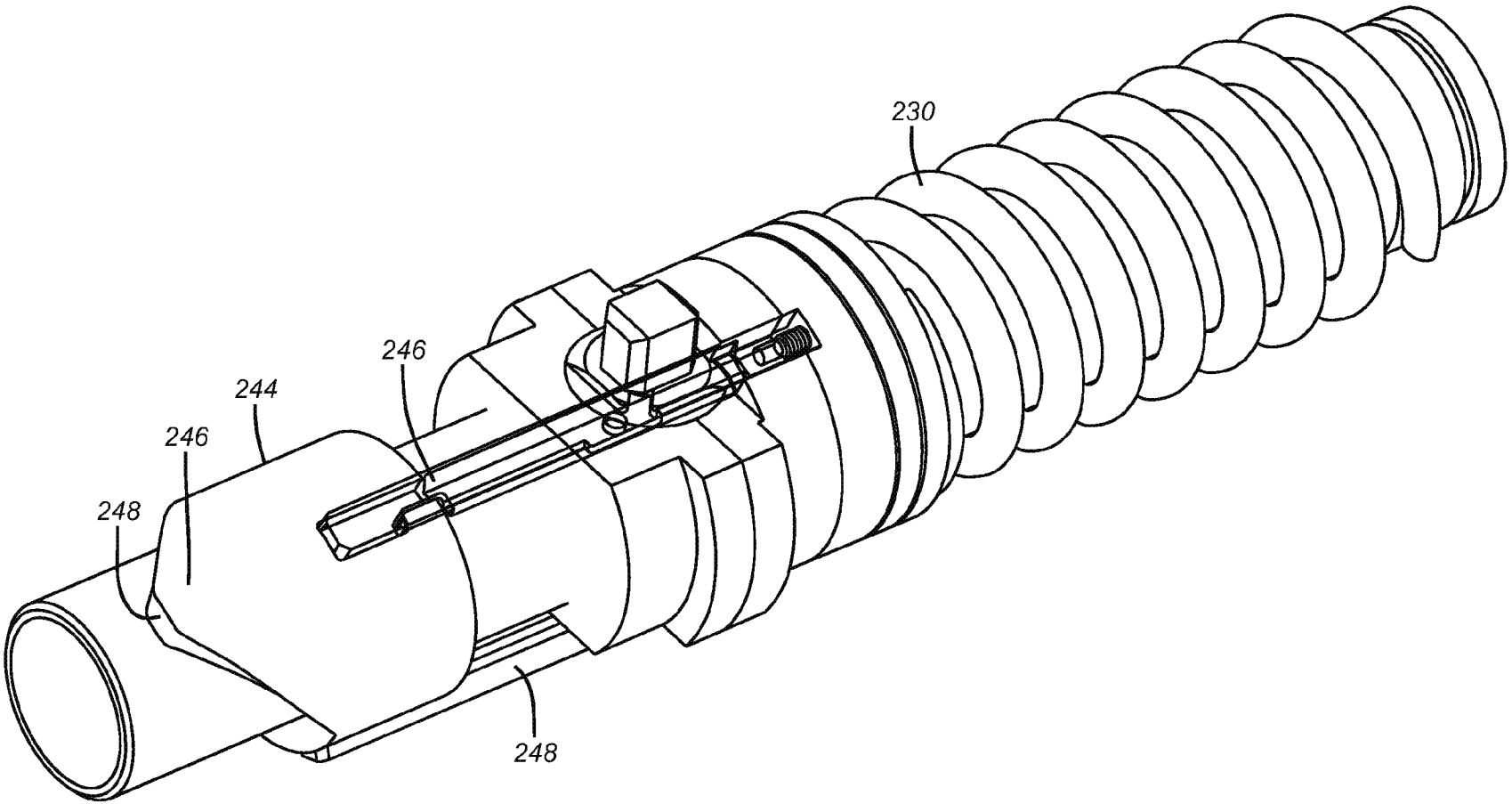

Referring now to FIGS. 8*i-j* and FIGS. 10 *a-b*, the operation of the valve assembly 44 will be reviewed. FIGS. 10*a-b* show how the valve assembly 44 is first rotated to close from the open position at run in and through various other steps shown in FIGS. 1-7. Spring 230 urges the ball 232 into the open position of FIG. 8*j*. To close the ball 232 the spring 230 has to be compressed using a j-slot mechanism 234. Mechanism 234 comprises the sleeve 236 with the external track 238. It has a lower triangularly shaped end that comes to a flat 242. An operator sleeve 244 has a triangularly shaped upper end 246 that ends in a flat 248. Sleeve 244 is connected by links 246 and 248 to ball 232 offset from the rotational axis of ball 232 with one of the connecting pins 250 to the ball 232 shown in FIG. 8*j* above the ball 232.

Figure 10C:
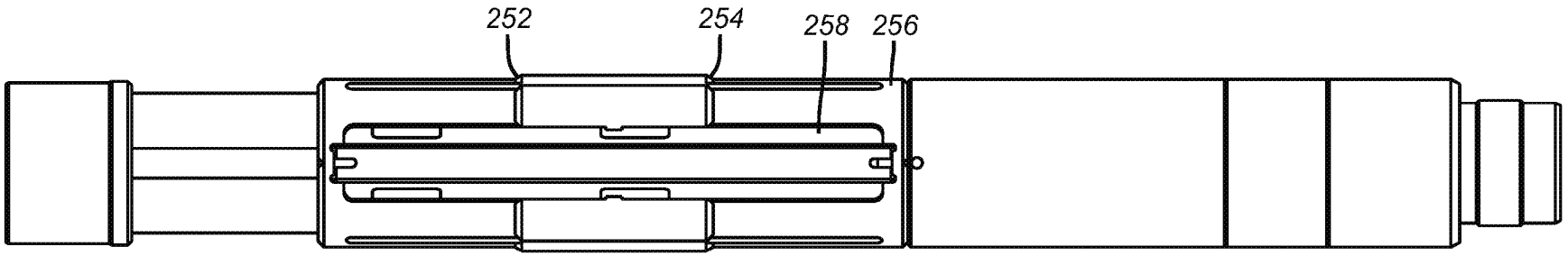

The j-slot mechanism 234 is actuated by engaging shoulder 252 (see FIG. 10*c*) when pulling up into a reduced bore such as 40 or when going down with set down weight and engaging shoulder 254 with a reduced bore such as 40. Sleeve 256 defines spaced collet fingers on the outside of which are found shoulders 252 and 256. FIG. 10*c* shows one of several openings 258 in sleeve 256 where the collet member 206 is mounted (see also FIG. 8*i*). Pin 260 on the collet 206 rides in track 238 of member 236 shown in FIG. 10*a*.

Run-in position shown in FIG. 1 starts with triangular components 240 and 246 misaligned with 270 degrees of remaining rotation required for alignment and closure of ball 232. The first pick up of valve assembly 44 into bore 40 advances triangular components 240 and 246 to 180 degrees of misalignment. Unrestrained upward movement of the inner string assembly 16 is possible until the metering position shown in FIG. 5 where it is important to note that valve assembly 44 remains collapsed in bore 40 until the metering time has elapsed. Once metered thru, the inner string assembly 16 continues upward allowing the collet sleeve 256 of valve assembly 44 to expand above bore 40. Downward movement of inner string assembly 16 allows shoulder 254 to interact with bore 40 resulting in triangular components 240 and 246 to advance to a position of 90 degrees misalignment. At this point typically circulate position shown in FIG. 4 is to be reached and gravel pumped. Upon completing the gravel pumping procedure inner string assembly 16 will be pulled upward. Valve assembly 44 will enter bore 40 to produce another rotation of 236 allowing triangular components 240 and 246 to align and ball 232 to close. To reiterate, each alternating interaction of shoulder 252 and 254 with respective shoulders of bore 40 produces a 90 degree rotation of j-slot sleeve 236. Successive interactions of the same shoulder, be it shoulder 252 or shoulder 254, by entering and exiting bore 40 without passing completely thru do not produce additional 90 degree rotations of j-slot sleeve 236. Of course the ball 232 can be opened after being closed as described above by pushing shoulder 254 back down through bore 40 get the flats 242 and 248 misaligned at which time the spring 230 rotates the ball 232 back to the open position.

When the inner string assembly 16 is pulled out the sleeve 114 will be unlocked, shifted and locked in its shifted position. Referring to FIG. 8*j* a series of shifting collets 252 have an uphole shifting shoulder 255 and a downhole shifting shoulder 257. When the inner string assembly 16 comes uphole the shoulder 255 will grab shoulder 258 of sleeve 260 shown in FIG. 8*e* and carry sleeve 260 off of trapped collet 116 thus releasing sleeve 114 to move uphole. Sleeve 260 will be carried up by the inner string assembly 16 until it bumps collet finger 266 at which point the sleeve 114 moves in tandem with the inner string assembly 16 until collet fingers 266 engage groove 268. At this point the collet fingers 266 deflect sufficiently to allow sleeve 260 to pass under collet finger 266. Sleeve 260 stops when it contacts shoulder 262, locking sleeve 114 in place. Since sleeve 114 is attached to ported sleeve 20 whose top end 264 is not restrained and is free to move up sleeves 114 and 20 will move in tandem with sleeve 260 until collets 266 land in groove 269 to allow sleeve 260 to go over collets 266 and shoulder 255 to release from sleeve 260 as the inner string assembly 16 comes out of the hole. This locks sleeve 114 in the closed position. At this time sleeve 114 will block ports 20 from the annulus 22 so that a production string can go into the packer 18 to produce through the screens (not shown) and through the packer 18 to the surface. The above described movements can be reversed to open ports 20. To do that the inner string assembly 16 is lowered so that shoulder 257 engages shoulder 270 on sleeve 260 to pull sleeve 260 off of collets 266. Sleeve 114 and with it the sleeve with ports 20 will get pushed down until collets 116 go into groove 272 so that sleeve 260 can go over them and shoulder 257 can release from sleeve 260 leaving the sleeve 114 locked in the same position it was in for run in as shown in FIG. 8*e*. Sleeve 114 is lockable at its opposed end positions.

Figure 11A:
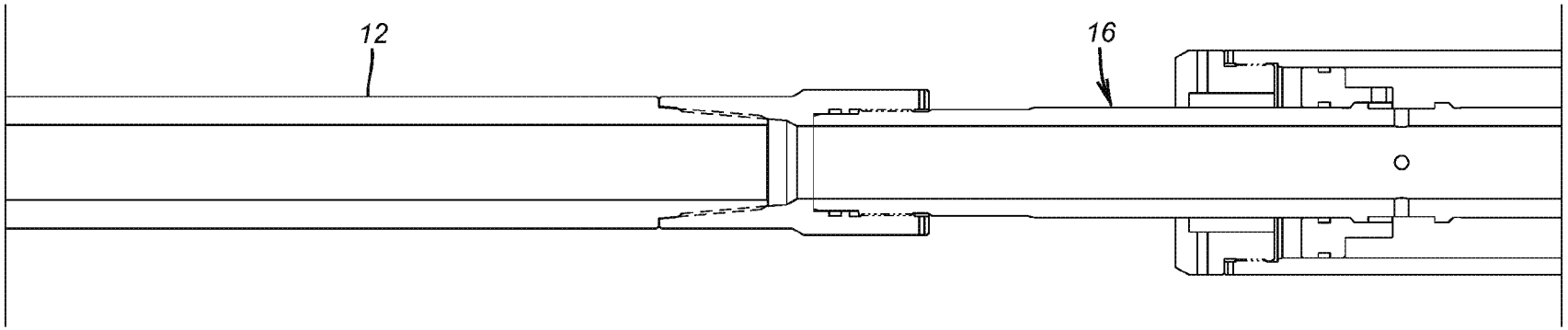
FIGS. 11*a-j* show the tool in the squeeze position of FIG. 3.
Figure 12A:
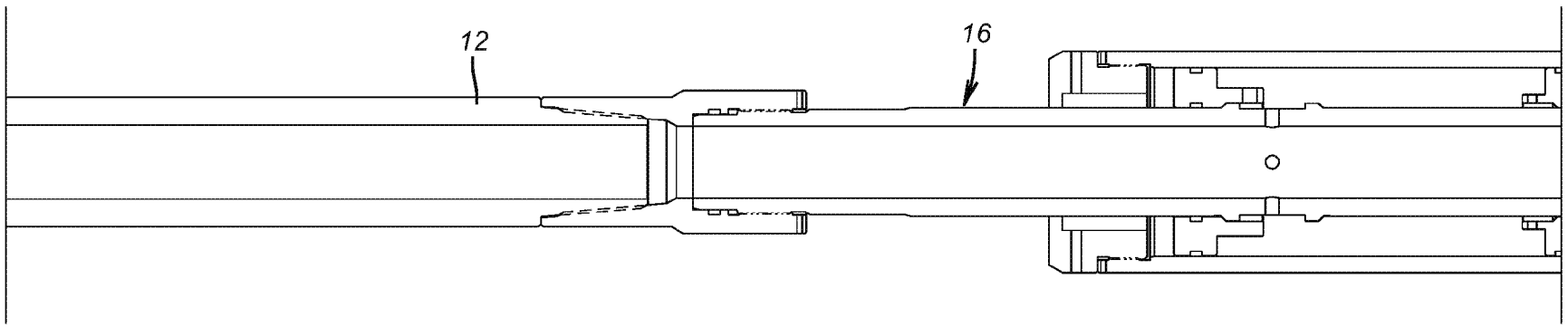
FIGS. 12*a-j* show the tool in the circulate position where gravel can be deposited, for example.
Figure 11B:
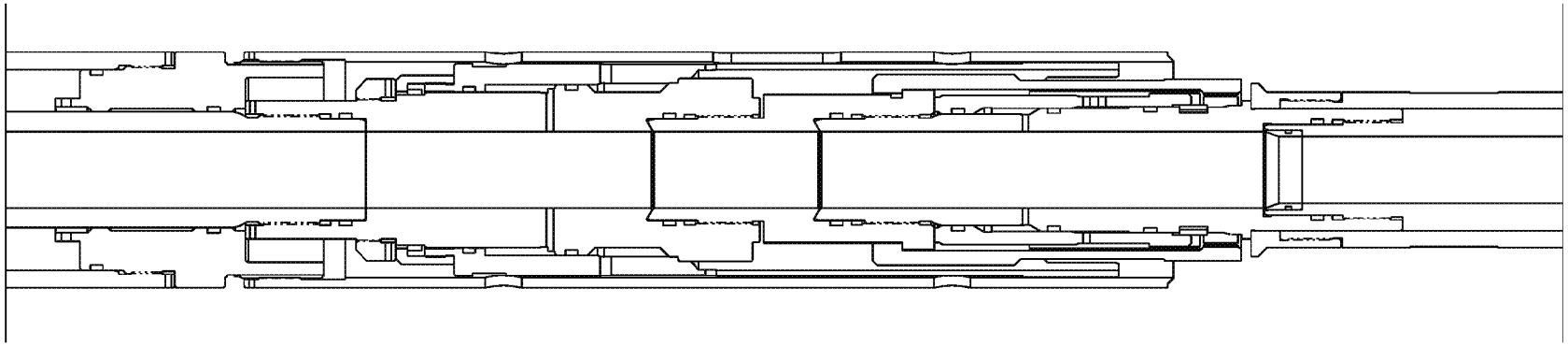
Figure 12B:
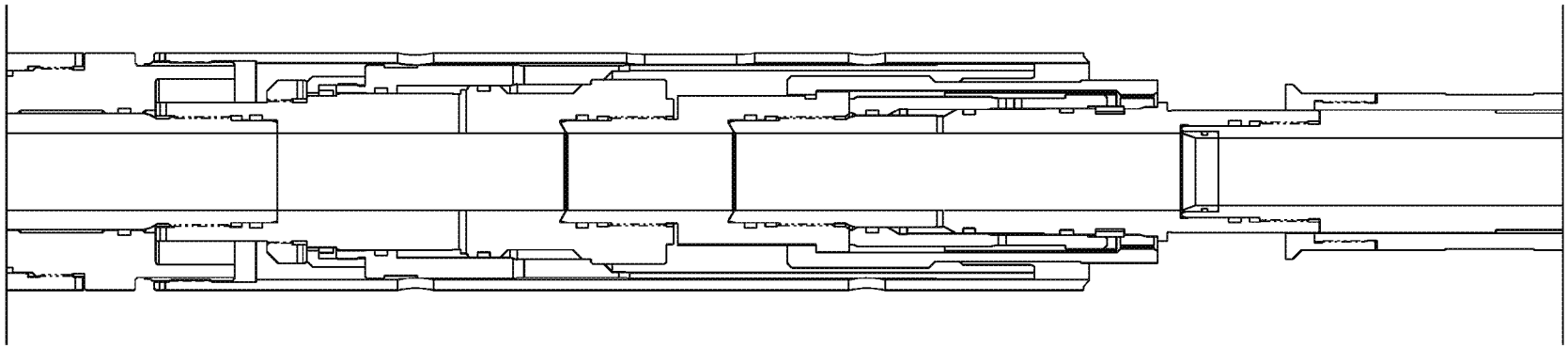
Figure 11C:
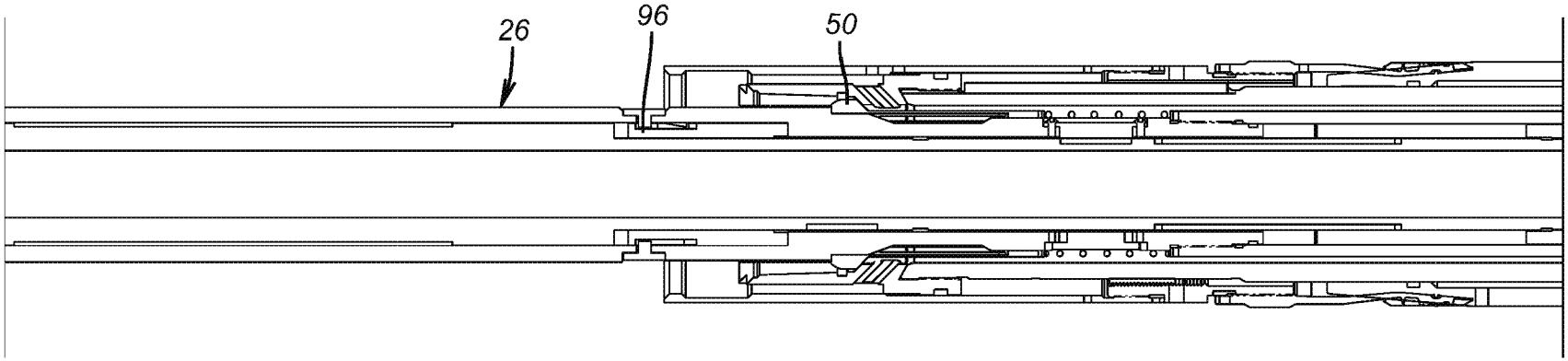
Figure 12C:
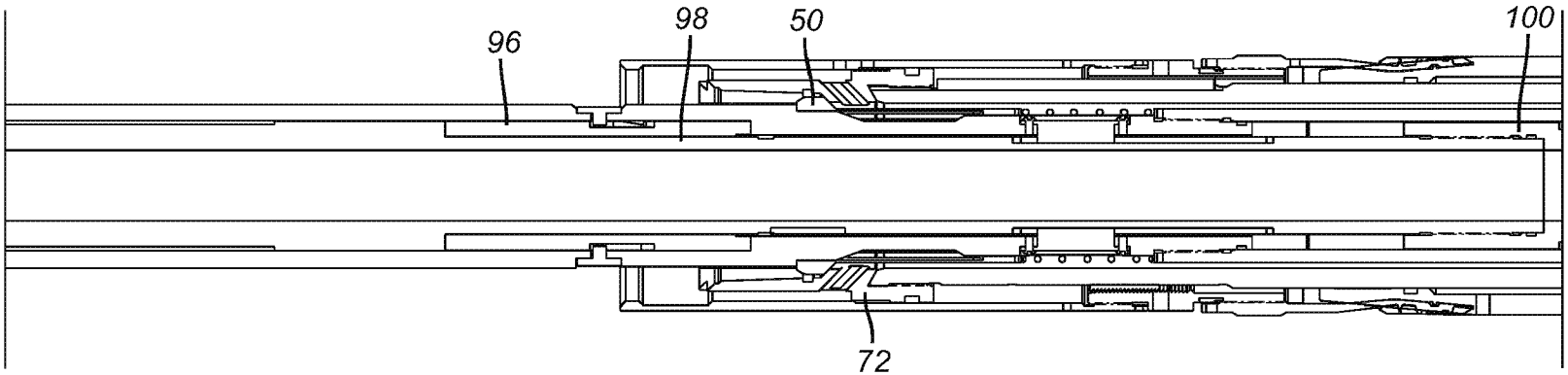
Figure 11D:
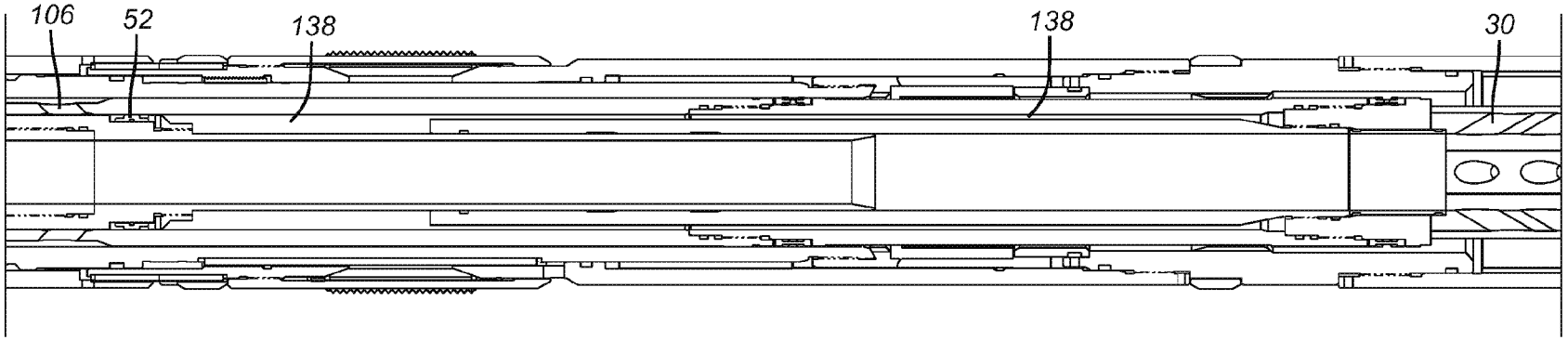
Figure 12D:
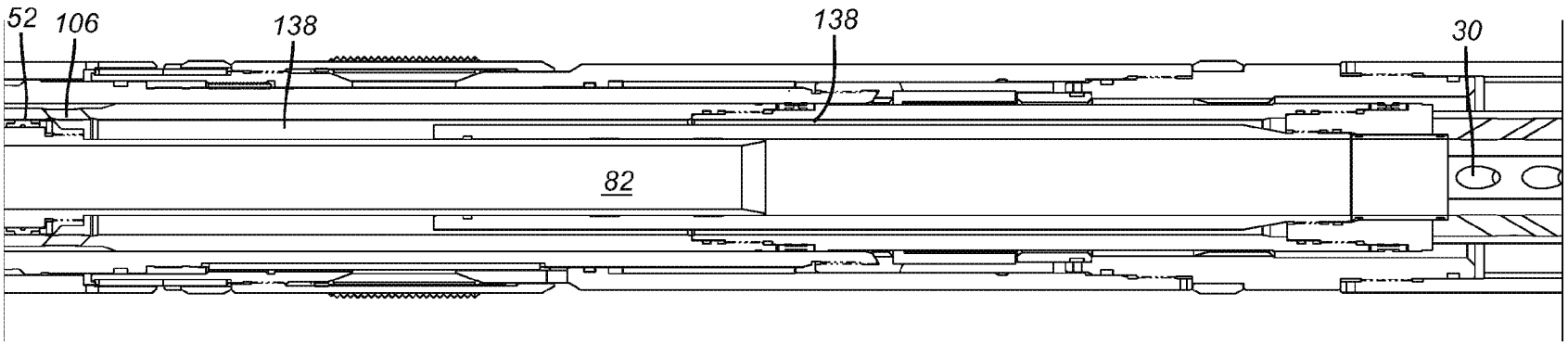
Figure 11E:
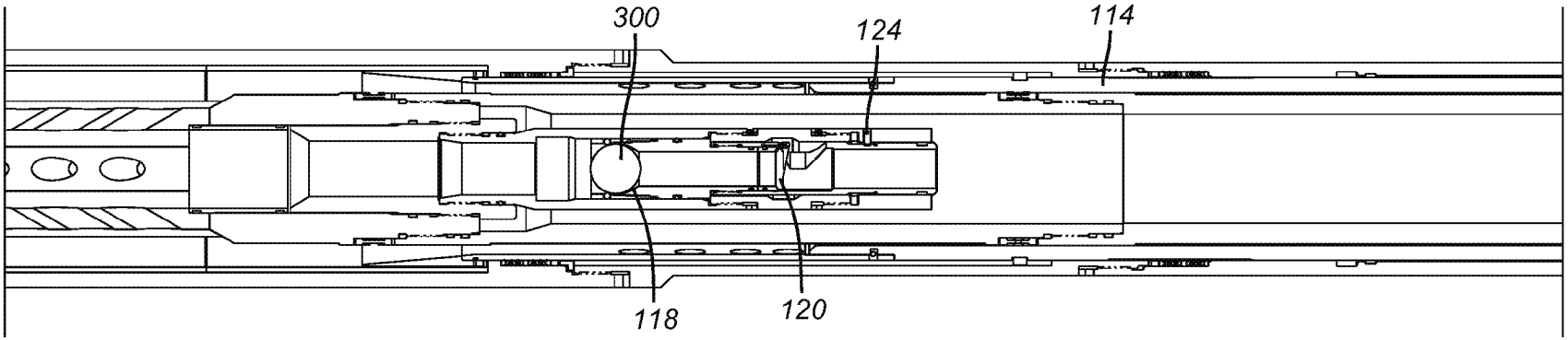
Figure 12E:
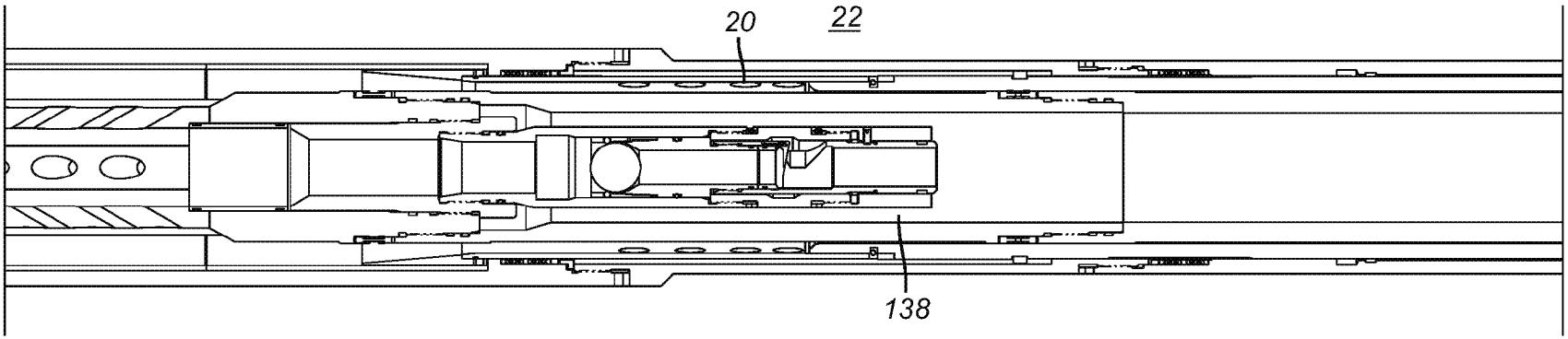

Referring now to FIGS. 11*a-j*, the squeeze position is shown. Comparing FIG. 11 to FIG. 8 it can be seen that there are several differences. As seen in FIG. 11*e*, the ball 48 has landed on seat 118 breaking shear pin 124 as the shifting of seat 118 allows the flapper 120 to close. The packer 18 has been set with pressure against the landed ball 48. With the packer 18 set the work string 12 picks up the inner string assembly 16 as shown in FIG. 11*a* such that the multi-acting circulation valve 26 as shown in FIG. 11*c* now has its collets 50 sitting on the packer upper sub 72 where formerly during run in the top 90 of the multi-acting circulation valve 26 sat during run in as shown in FIG. 8*b*. With the weight set down on the inner string assembly 16 the seal 52 is below ports 106 so that a return path 138 is closed. This isolates the upper annulus 56 (see FIG. 3) from the screens (not shown) at the formation. As mentioned before the j-slot 96 allows for alternative positioning of seal 52 below ports 106 for the squeeze position and for assumption of the circulation position of seal 52 being above ports 106 on alternate pickup and set down forces of the inner string assembly 16. The position in FIG. 11*d* can be quickly obtained if there is fluid loss into the formation so that the upper annulus 56 can quickly be closed. This can be done without having to operate the valve assembly 44 which means that subsequent uphole movements will not swab the formation as those uphole movements are made with flow communication to the upper annulus 56 while fluid loss to the formation can be dealt with in the multi-acting circulation valve 26 being in the closed position by setting down with the j-slot 96 into the reverse position.

Figure 11F:
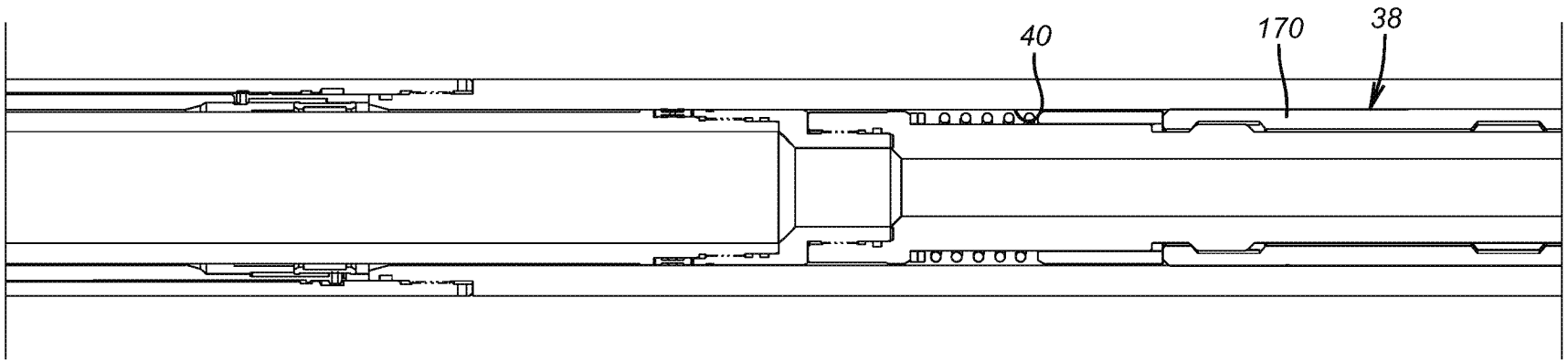
Figure 12F:
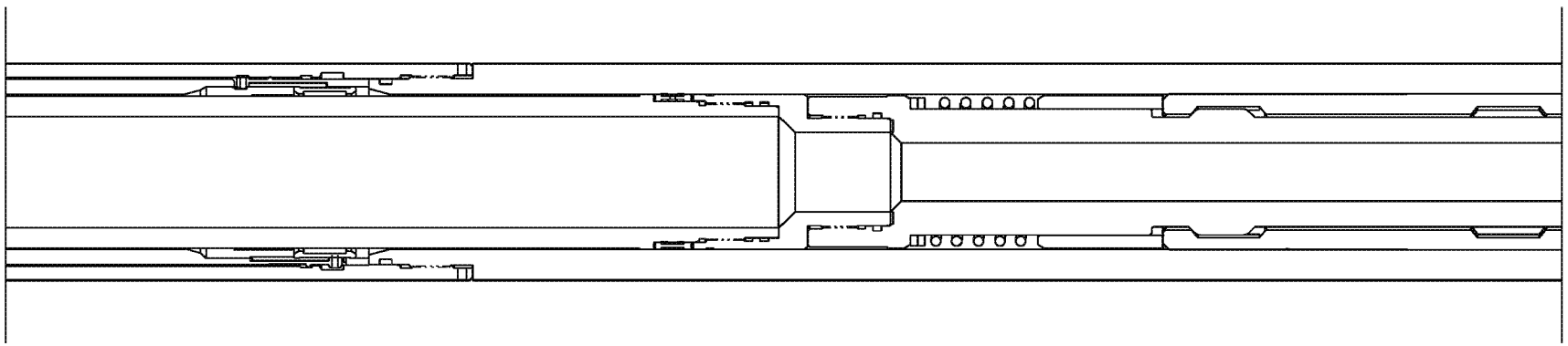
Figure 11G:
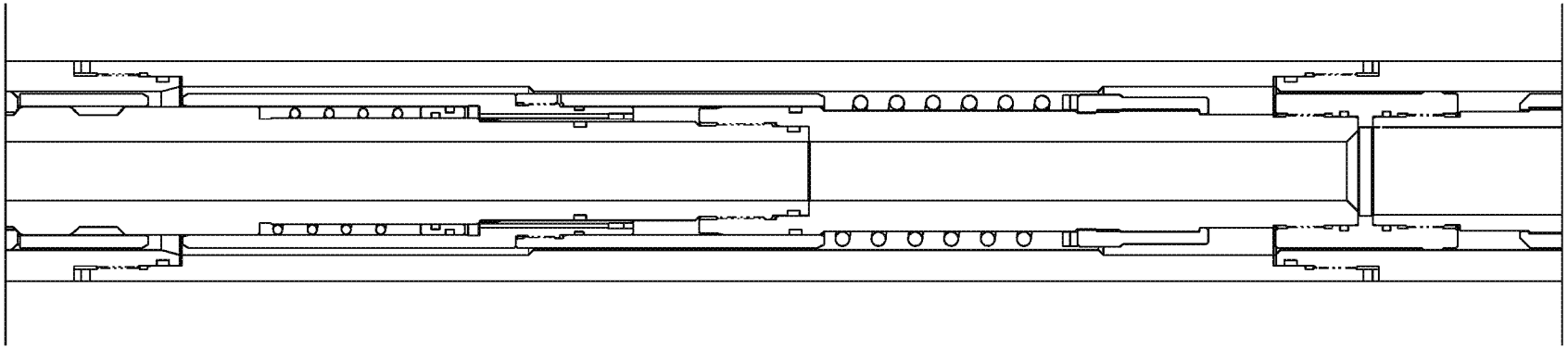
Figure 12G:
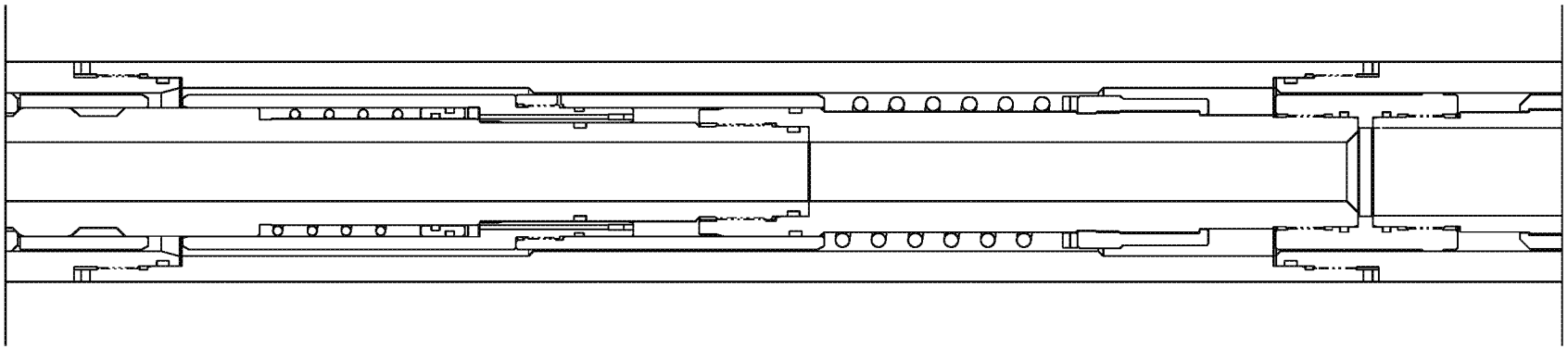
Figure 11H:
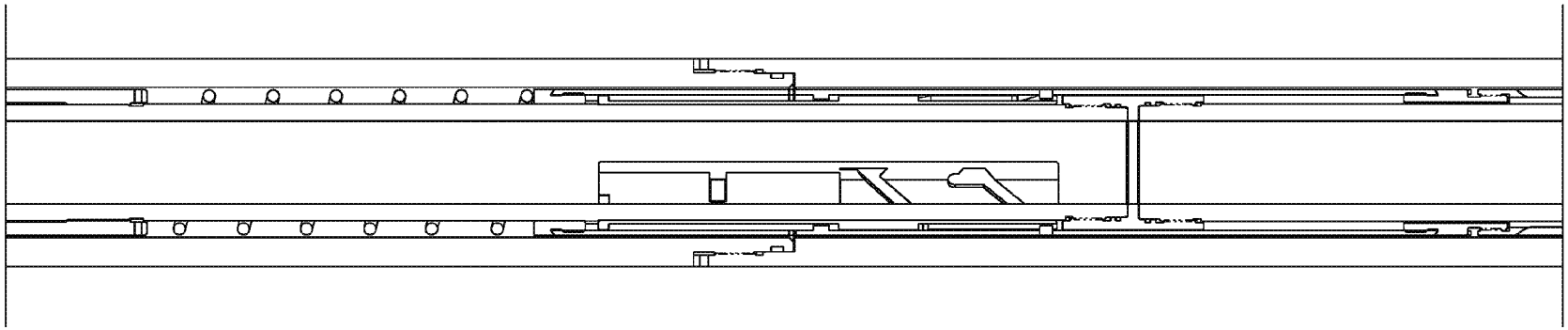
Figure 12H:
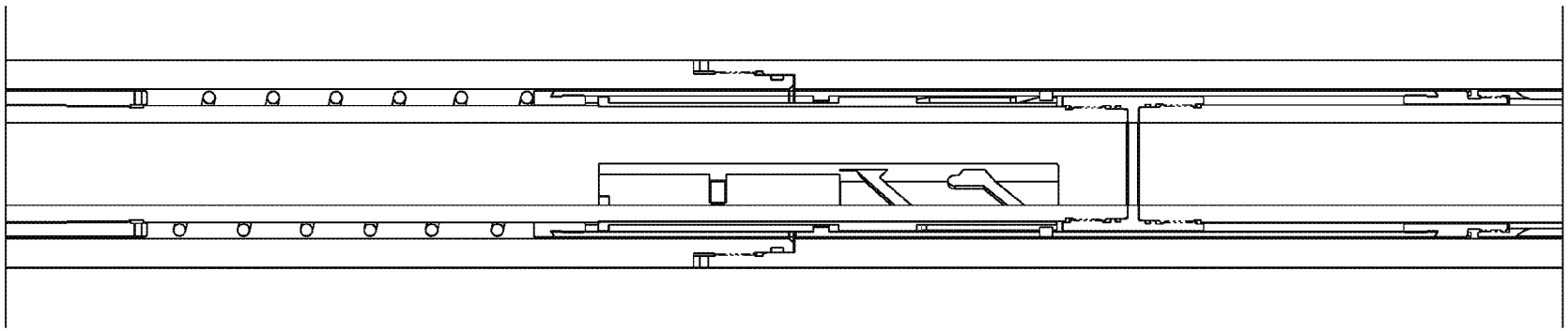
Figure 11I:
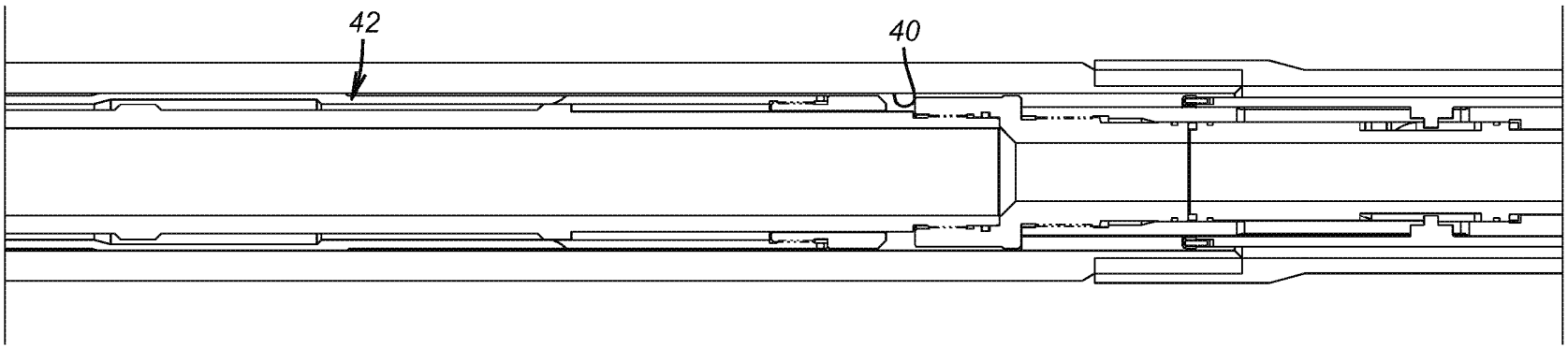
Figure 12I:
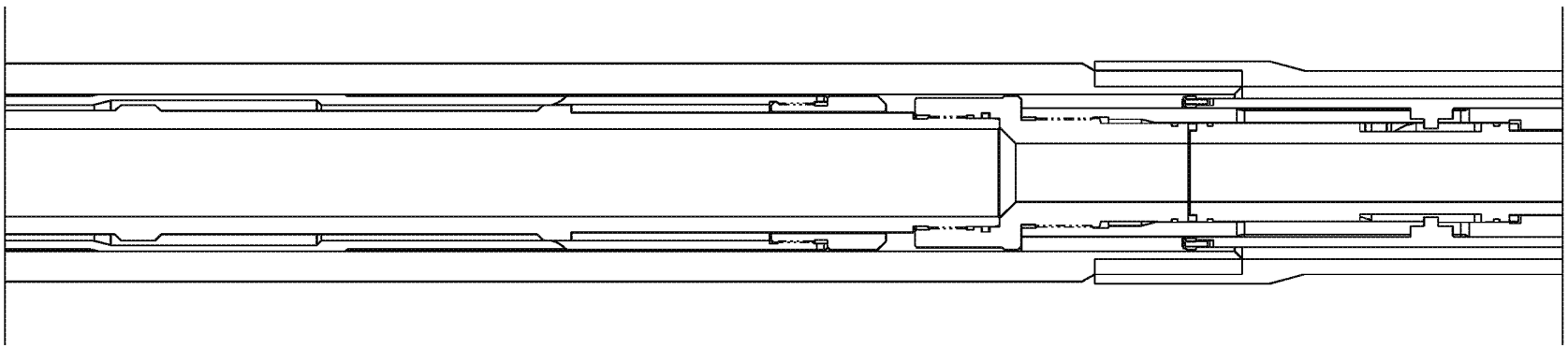
Figure 11J:
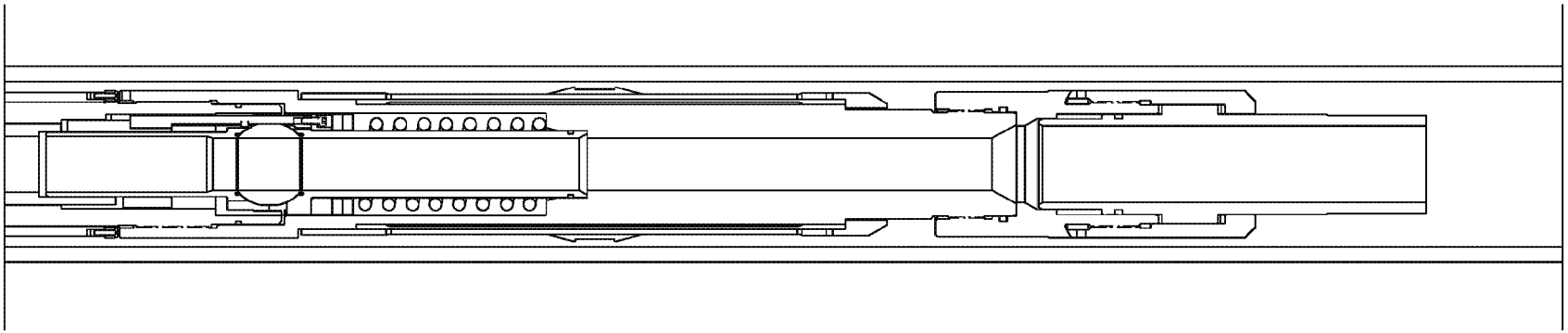
Figure 12J:
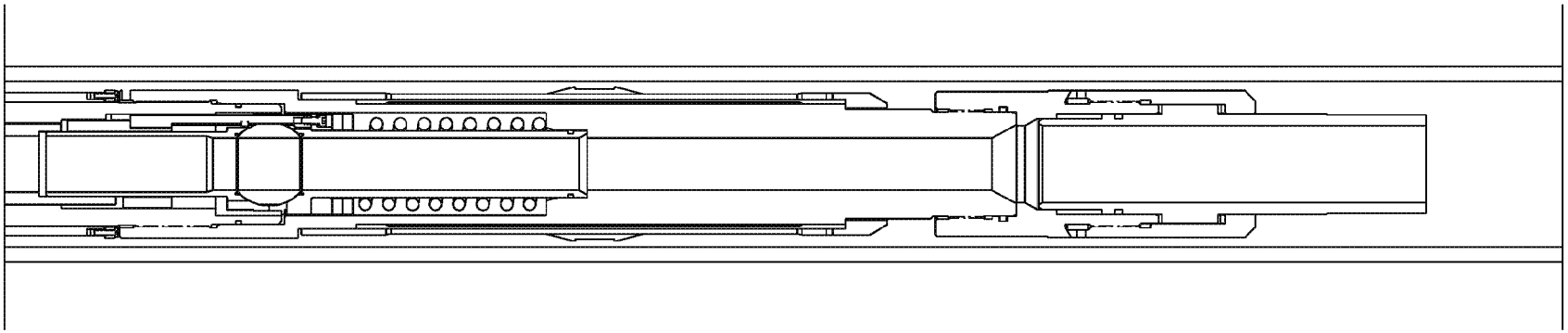
Figure 14A:
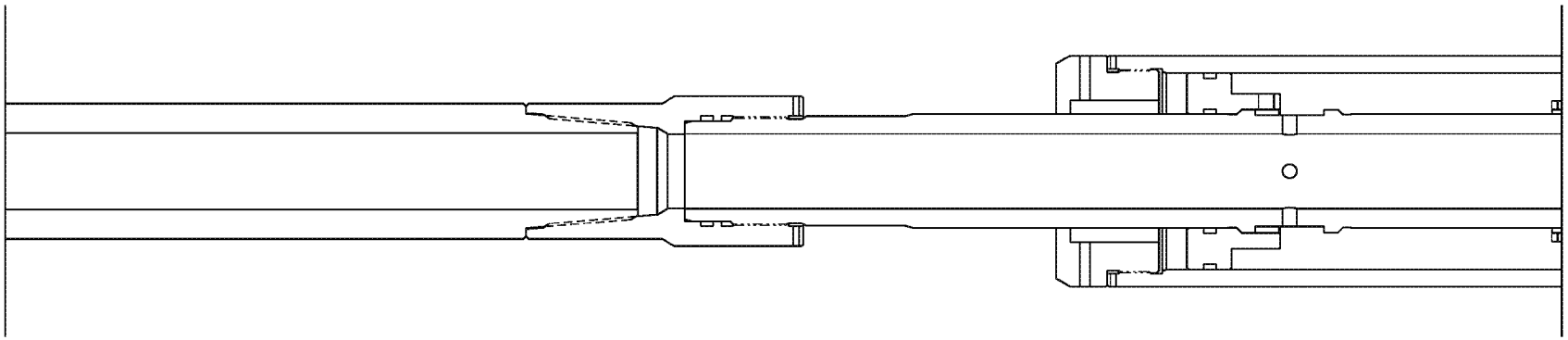
FIGS. 14*a-j* show the apparatus in the reverse position with the low bottom hole pressure ball valve open.
Figure 14B:
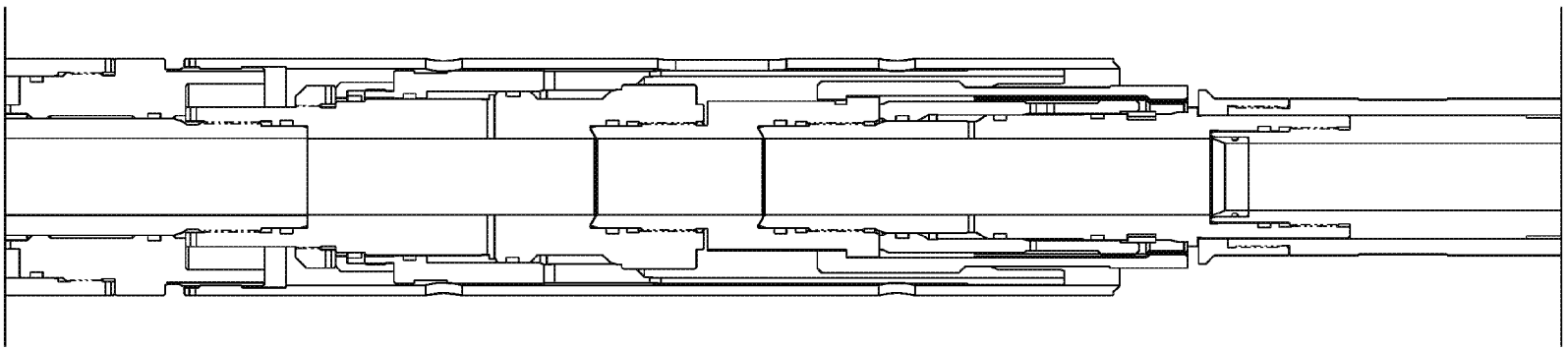
Figure 14C:
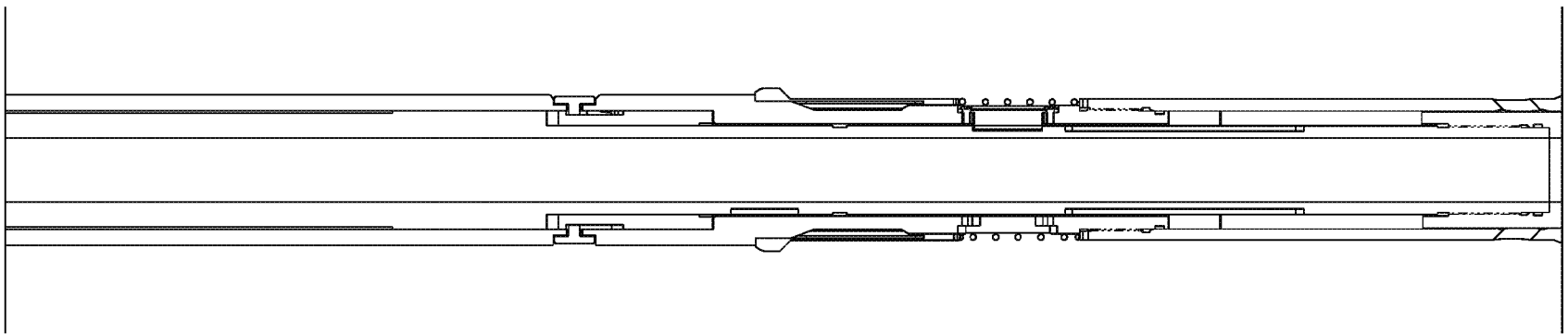
Figure 14D:
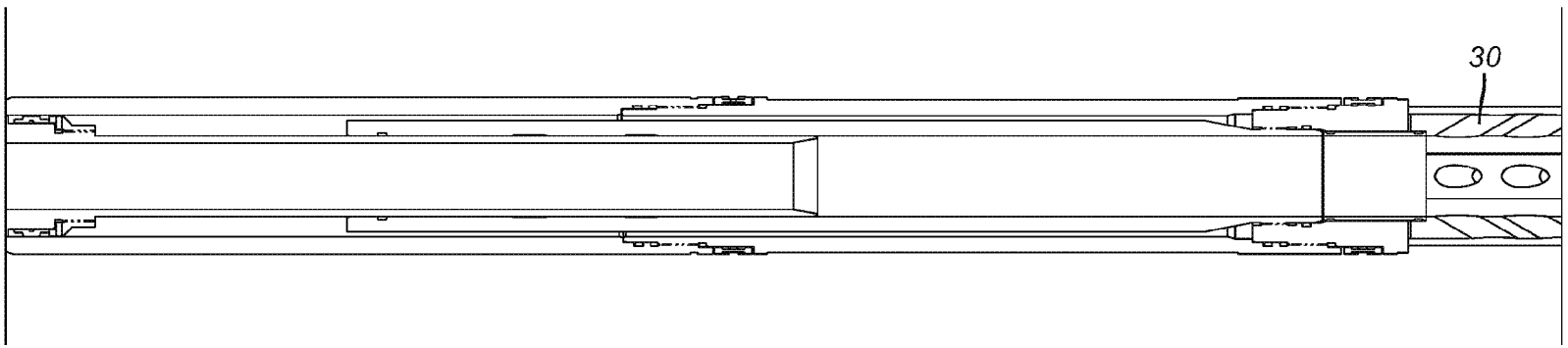

It should also be noted that the internal gravel exit ports 30 are now well above the sliding sleeve 114 that initially blocked them to allow the packer 18 to be set. This is shown in FIGS. 11*d-e*. As shown in FIG. 3 and FIG. 11*f*, the metering dogs 170 of the metering device 38 are in bore 40 as is the reciprocating set down device assembly 42 shown in FIG. 11*i*. The valve assembly 44 is below bore 40 and will stay there when shifting between the squeeze and circulate positions of FIGS. 3 and 4.

FIG. 12 is similar to FIG. 11 with the main difference being that the j-slot 96 puts sleeves 98 and 100 in a different position after picking up and setting down weight on the inner string assembly 16 so that the seal 52 is above the ports 106 opening a return path 138 through the ports 106 to the upper annulus 56. This is shown in FIG. 12*c-d*. The established circulation path is down the inner string assembly 16 through passage 82 and out ports 30 and then ports 20 to the outer annulus 22 followed by going through the screens (not shown) and then back up the inner string assembly 16 to passage 138 and through ports 106 and into the upper annulus 56. It should also be noted that the squeeze position of FIG. 11 can be returned to from the FIG. 12 circulation position by simply picking up the inner string assembly 16 and setting it down again using j-slot 96 with the multi-acting circulation valve 26 supported off the packer upper sub 72 at collets 50. This is significant for several reasons. First the same landing position on the packer upper sub 72 is used for circulation and squeezing as opposed to past designs that required landing at axially discrete locations for those two positions causing some doubt in deep wells if the proper location has been landed on by a locating collet. Switching between circulate and squeeze also poses no danger of closing the valve assembly 44 so that there is no risk of swabbing in future picking up of the inner string assembly 16. In prior designs the uncertainty of attaining the correct locations mainly for the reverse step at times caused inadvertent release of the wash pipe valve to the closed position because the shear mechanism holding it open was normally set low enough that surface personnel could easily shear it inadvertently. What then happened with past designs is that subsequent picking up of the inner string swabbed the well. Apart from this advantage, even when in the circulation configuration of FIG. 12 for the multi-acting circulation valve 26, the squeeze position of multi-acting circulation valve 26 can be quickly resumed to reposition seal 52 with respect to ports 106 to prevent fluid losses, when in the reverse position, to the formation with no risk of operating the valve assembly 44.

It is worth noting that when the string 12 is picked up the multi-acting circulation valve 26 continues to rest on the packer sub 72 until shoulders 95 and 97 come into contact. It is during that initial movement that brings shoulders 95 and 97 together that seal 52 moves past ports 106. This is a very short distance preferably under a few inches. When this happens the upper annulus 56 is in fluid communication with the lower annulus 22 before the inner string assembly 16 picks up housing 134 of the multi-acting circulation valve 26 and the equipment it supports including the metering assembly 38, the reciprocating set down device 42 and the valve assembly 44. This initial movement of the sleeves 98 and 100 without housing 134 and the equipment it supports moving at all is a lost motion feature to expose the upper annulus 56 to the lower annulus 22 before the bulk of the inner string assembly 16 moves when shoulders 95 and 97 engage. In essence when the totality of the inner string assembly 16 begins to move, the upper annulus 56 is already communicating with the lower annulus 22 to prevent swabbing. The j-slot assembly 96 and the connected sleeves 98 and 100 are capable of being operated to switch between the squeeze and circulate positions without lifting the inner string assembly 16 below the multi-acting circulation valve 26 and its housing 134. In that way it is always easy to know which of those two positions the assembly is in while at the same time having an assurance of opening up the upper annulus 56 before moving the lower portion of the inner string assembly 16 and having the further advantage of quickly closing off the upper annulus 56 if there is a sudden fluid loss to the lower annulus 22 by at most a short pickup and set down if the multi-acting circulation valve 26 was in the circulate position at the time of the onset of the fluid loss. This is to be contrasted with prior designs that inevitably have to move the entire inner string assembly to assume the squeeze, circulate and reverse positions forcing movement of several feet before a port is brought into position to communicate the upper annulus to the lower annulus and in the meantime the well can be swabbed during that long movement of the entire inner string with respect to the packer bore.

Figure 13A:
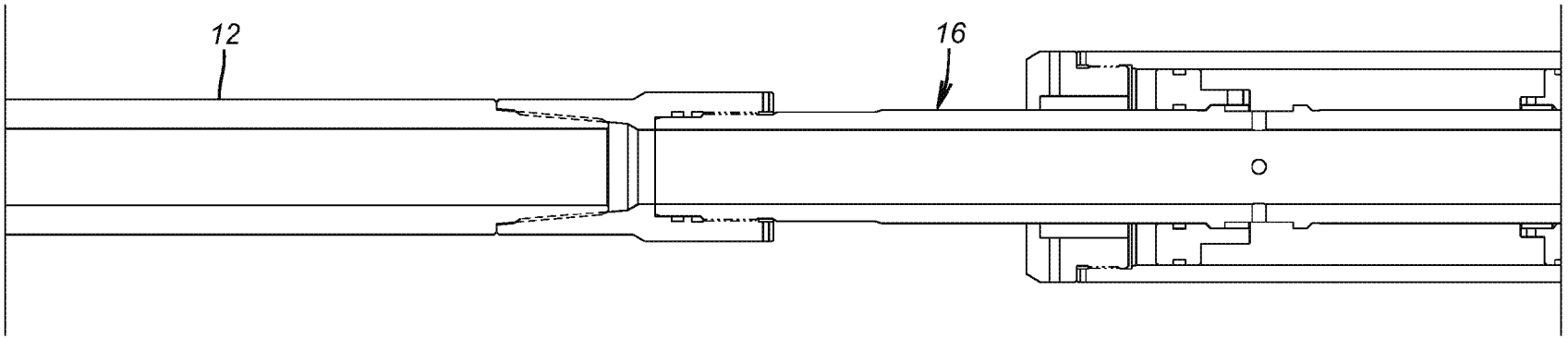
FIGS. 13*a-j* show the metering position which can arm the low bottom hole pressure ball valve to then close.
Figure 13B:
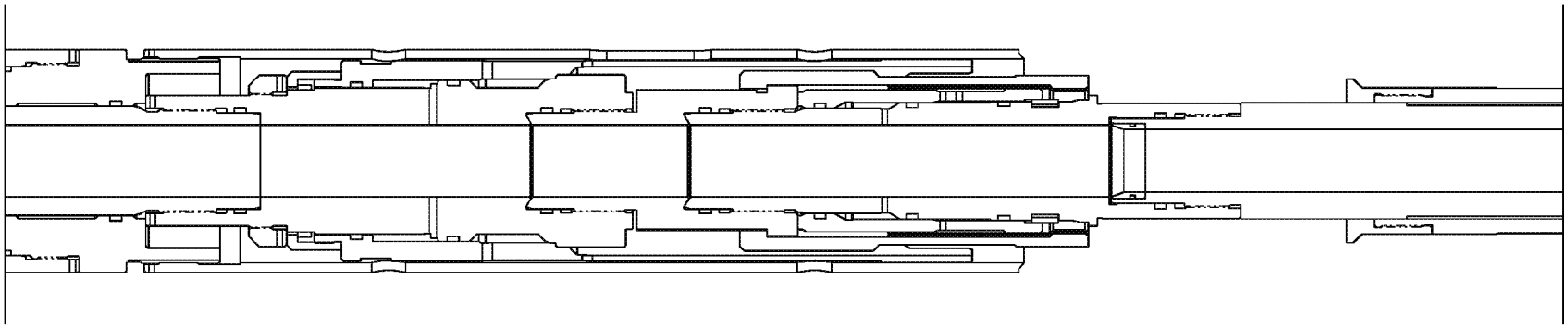
Figure 13C:
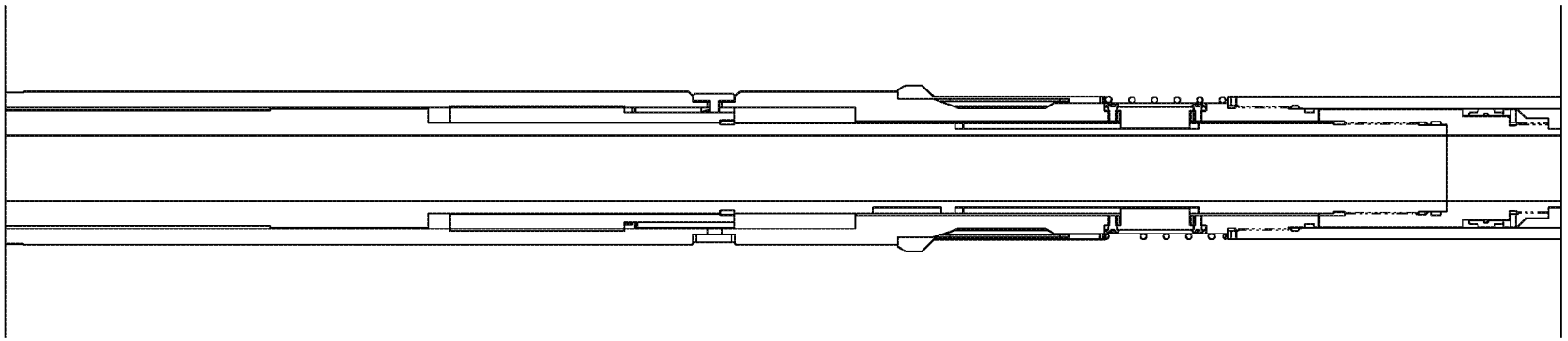
Figure 13D:
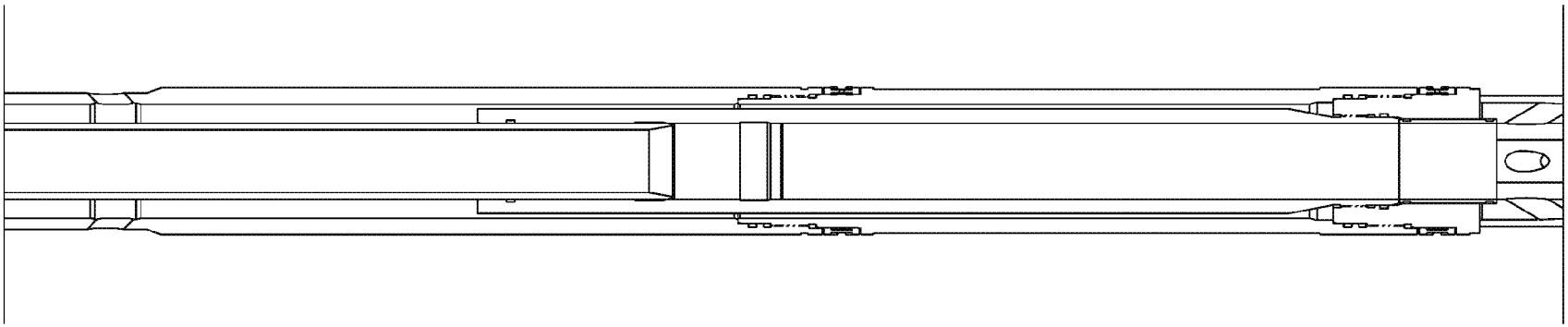
Figure 13E:
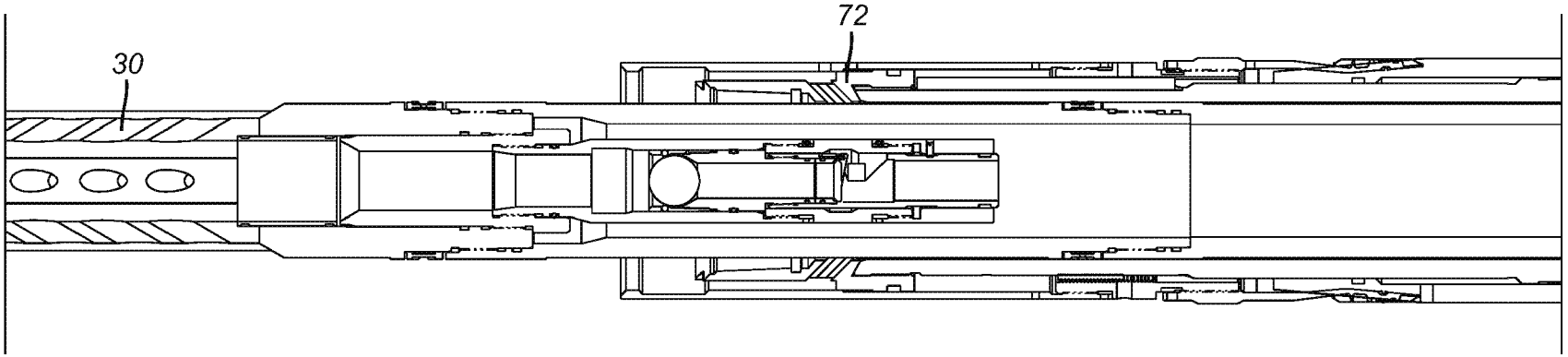
Figure 14E:
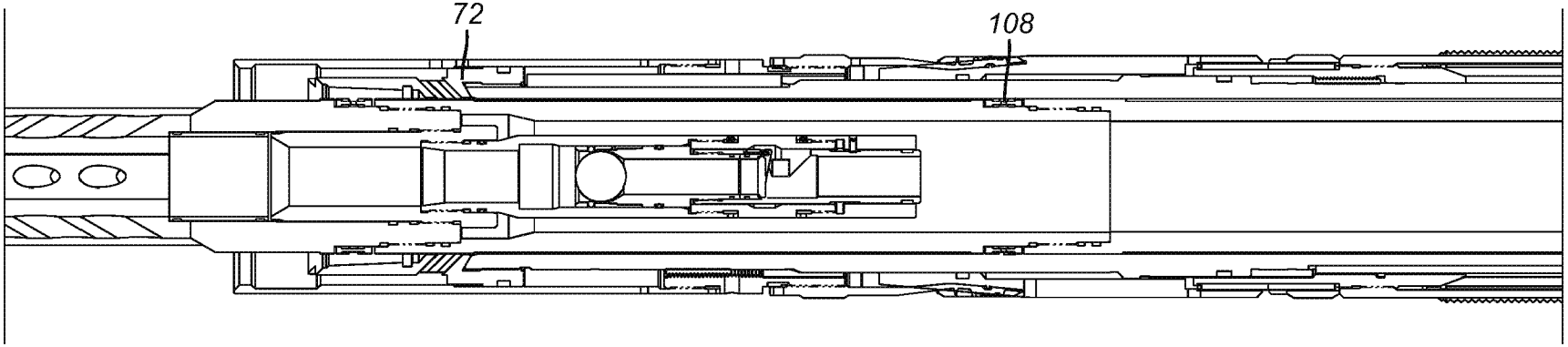
Figure 13F:
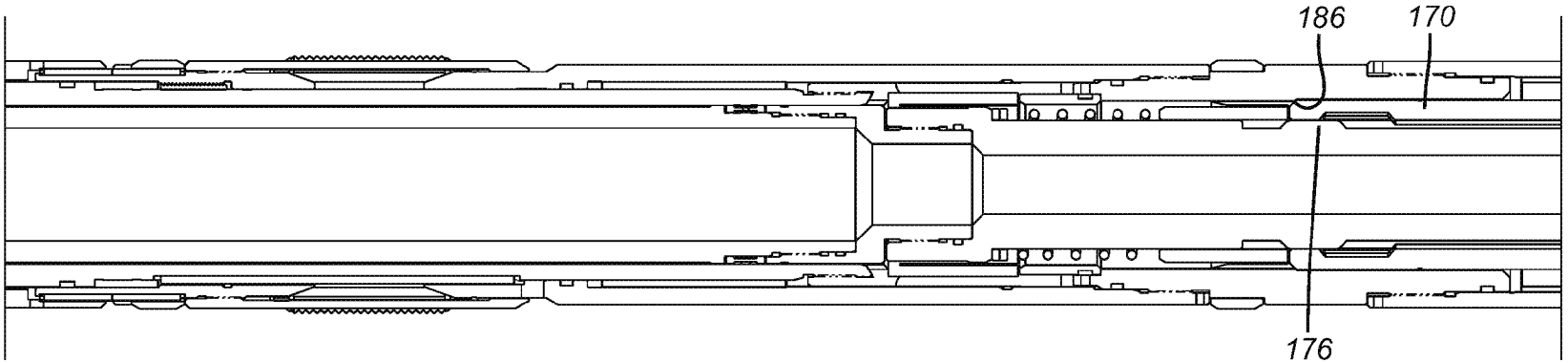
Figure 14F:
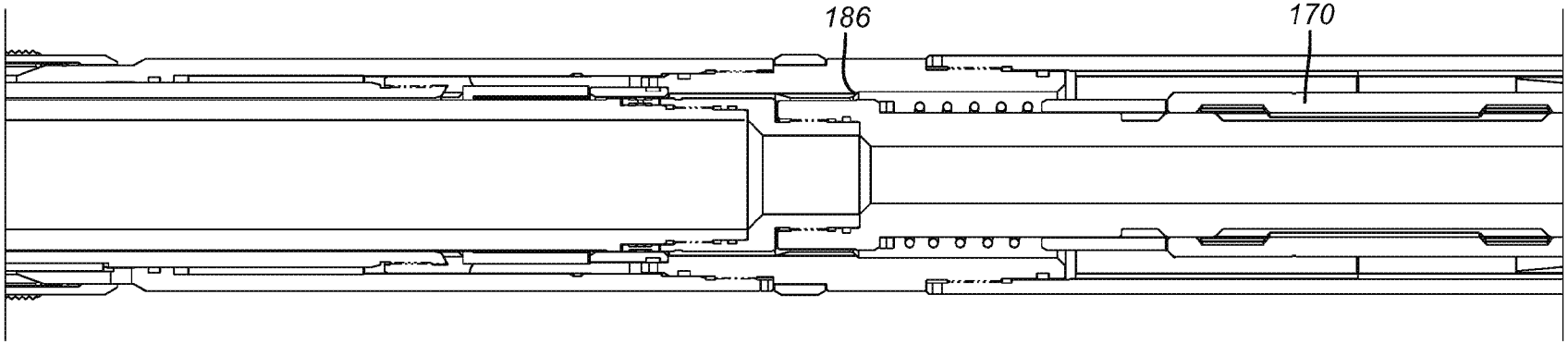
Figure 13G:
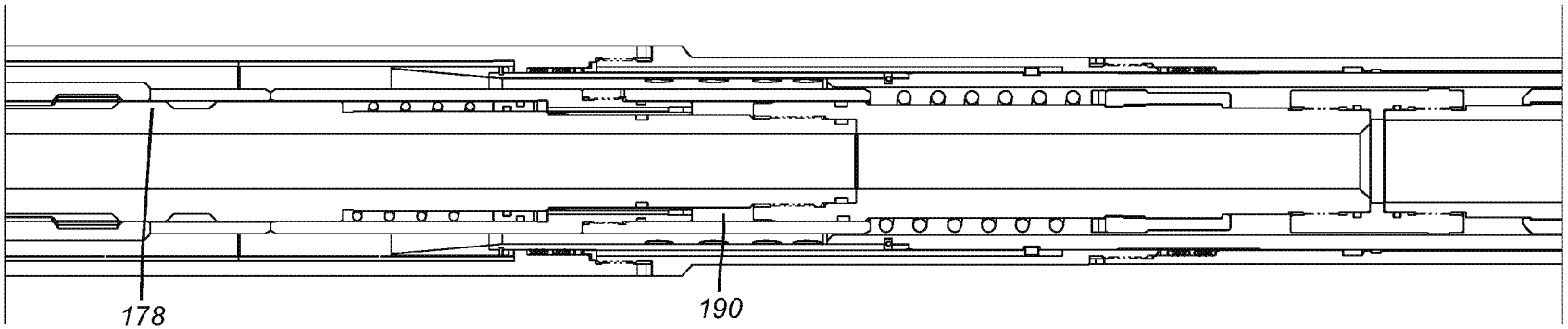
Figure 14G:
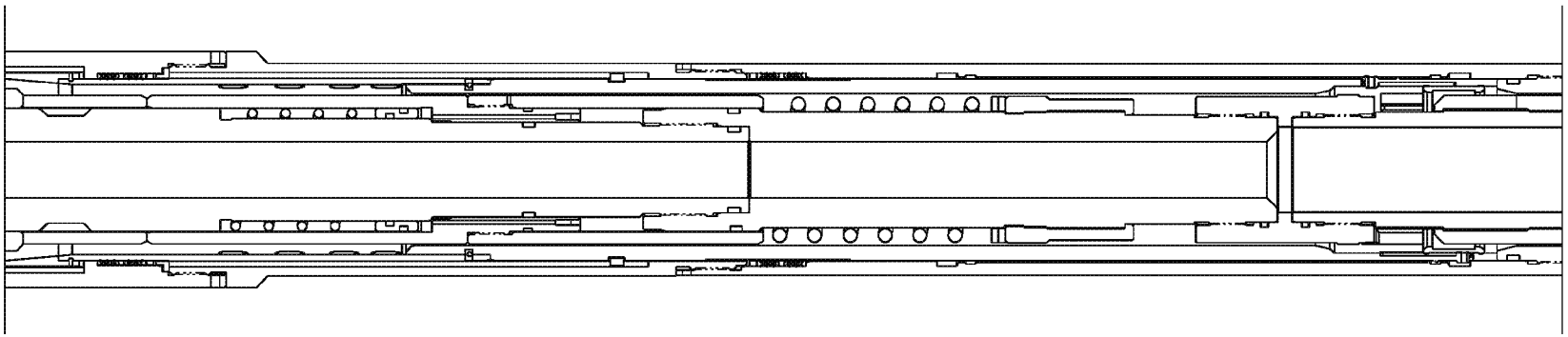
Figure 13H:
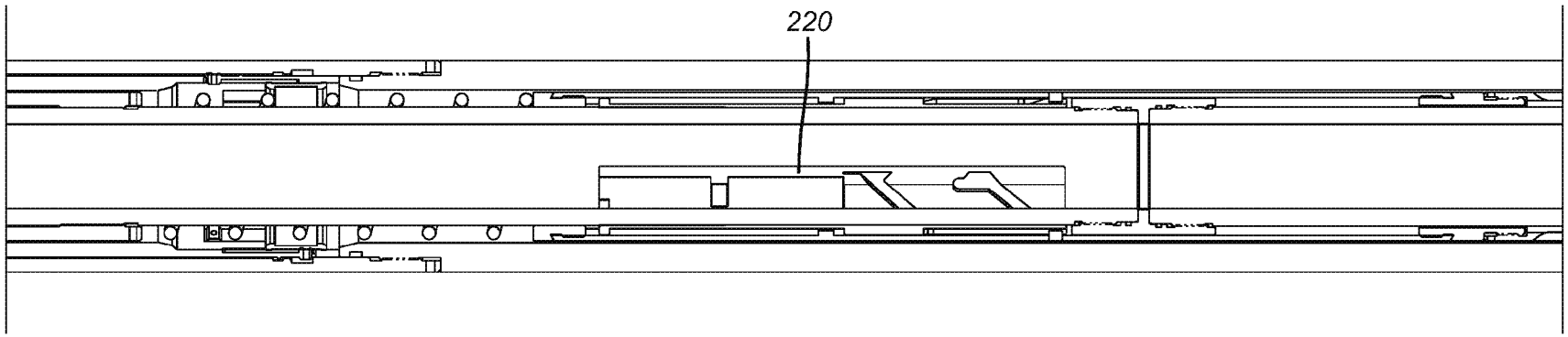
Figure 14H:
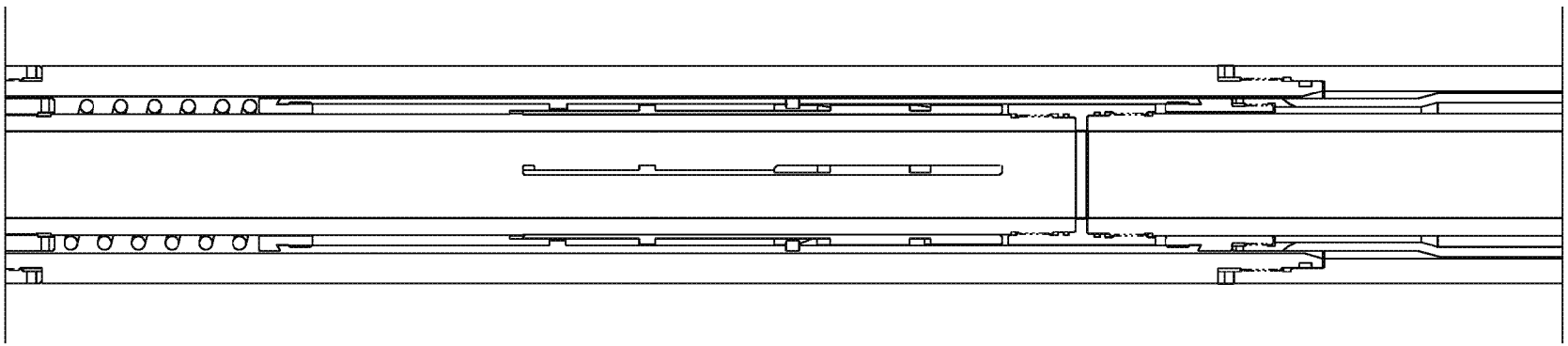

In FIG. 13 the inner string assembly 16 has been picked up to get the gravel exit ports 30 out of the packer upper sub 72 as shown in FIG. 13*e*. The travel limit of the string assembly 16 is reached when the metering dogs 170 shoulder out at shoulder 186 as shown in FIG. 13*f-g* and get support from humps 176 and 178. At this time the reciprocating set down device 42 shown in FIG. 13*i* is out of bore 40 so that when weight is set down on the inner string assembly 16 after getting to the FIG. 13 position and as shown in FIG. 13*i*, the travel stop 224 will land on shoulder 226 which will put hump 228 behind shoulder 218 and trap shoulder 218 to shoulder 219 on the outer string 24 supported by the packer 18. As stated before, the reciprocating set down device 42 has a j-slot assembly 220 shown in FIG. 13*h* that will allow it to collapse past shoulder 219 simply by picking up off of shoulder 219 and setting right back down again. By executing the metering operation and displacing enough hydraulic fluid from reservoir 190 shown in FIG. 13*g* the valve assembly 44 is pulled through bore 40 that is now located below FIG. 13*j*. Pulling valve assembly 44 once through bore 40 turns its j-slot 234 90 degrees but flats 242 and 248 in FIGS. 10*a-b* are still offset. Going back down all the way through bore 40 will result in another 90 degree rotation of the j-slot 234 with the flats 242 and 248 still being out of alignment and the valve assembly 44 is still open. However, picking up the inner string assembly 16 to get valve assembly 44 through bore 40 a third time will align the flats 242 and 248 to close the valve assembly 44. Valve assembly 44 can be reopened with a set down back through bore 40 enough to offset the flats 242 and 248 so that spring 230 can power the valve to open again.

Figure 13I:
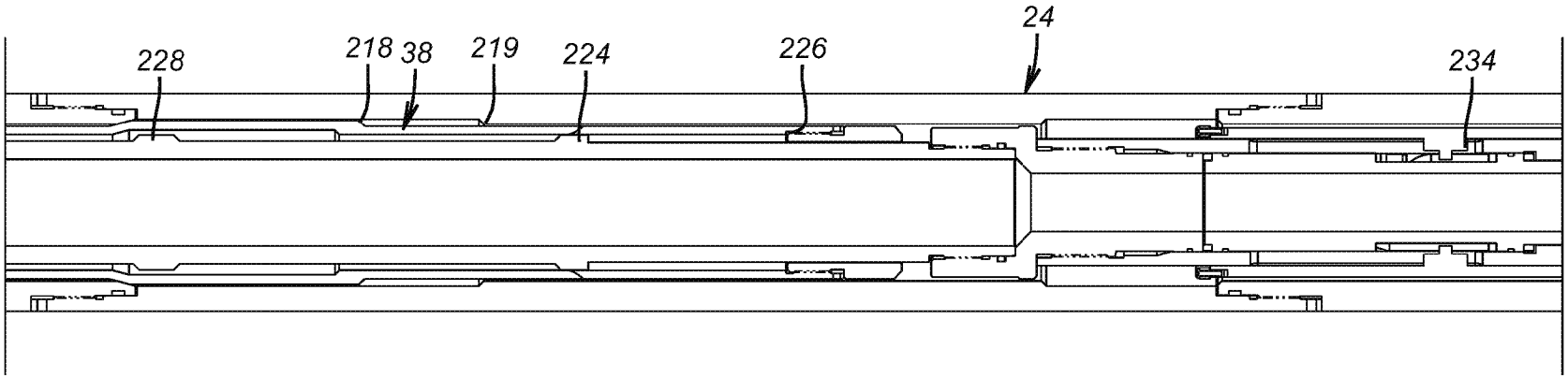
Figure 14I:
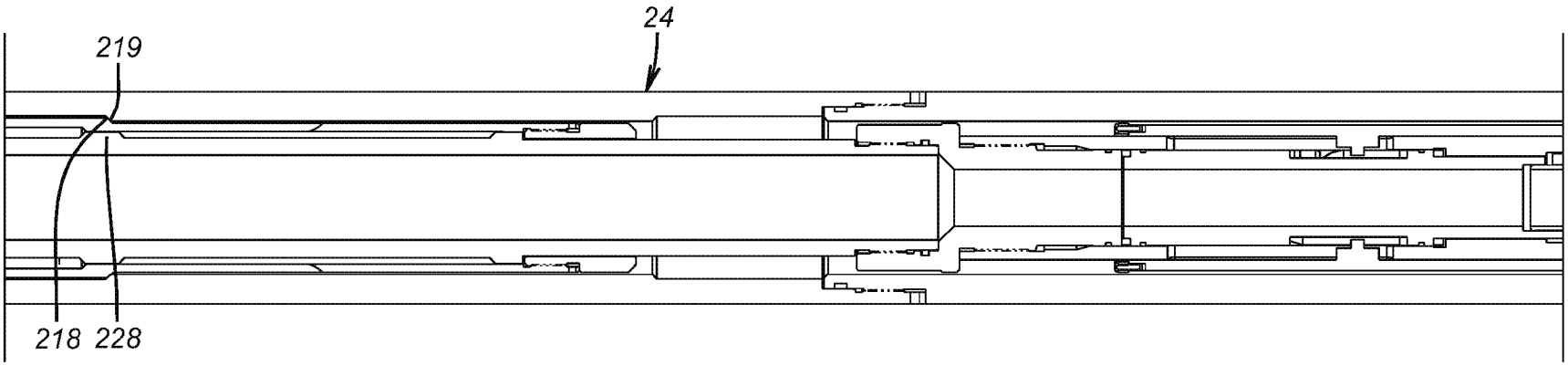
Figure 13J:
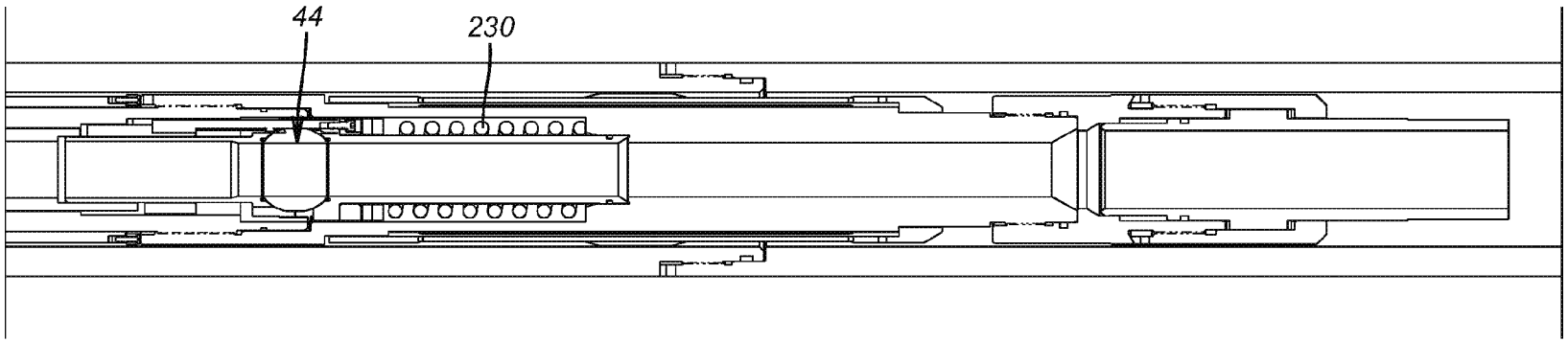
Figure 14J:
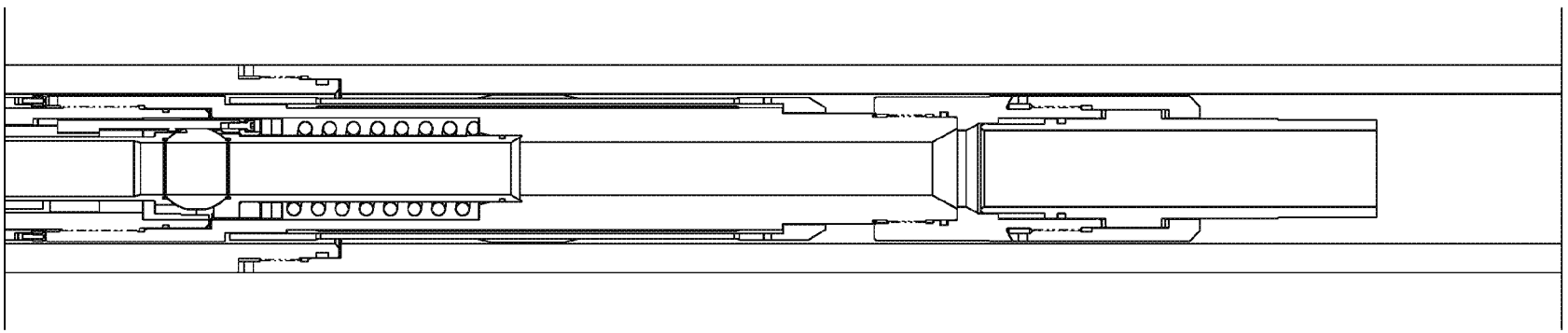

The only difference between FIGS. 13 and 14 is in FIG. 13*i* compared to FIG. 14*i*. The difference is that in FIG. 14*i* weight has been set down after lifting high enough to get dogs 170 up to shoulder 186 and setting down again without metering though, which means without lifting valve assembly 44 through bore 40 all the way. FIG. 14*f* shows the dogs 170 after setting down and away from their stop shoulder 186. FIG. 14*i* shows the hump 228 backing the shoulder 218 of the reciprocating set down device 42 onto shoulder 219 of the outer string 24.

Note also that the ports 30 are above the packer upper sub 72. The inner string assembly 16 is sealed in the packer upper sub 72 at seal 28.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claims, including the full range of equivalency to which each element thereof is entitled.

We claim:

1. A well treatment method for squeezing and gravel packing, comprising;

running in an outer assembly that comprises a packer, an outer string supported by said packer and leading to at least one screen and further comprising at least one outer exit port between said packer and said screen;

supporting said outer assembly with an inner string assembly for run in where the inner string assembly is in turn supported on a running string and the inner string assembly comprises a crossover tool to selectively allow gravel to pass through the inner string assembly and out toward said outer exit port of said outer assembly with returns coming through said screen and said crossover tool to an upper annulus defined above said packer and around said running string;

setting said packer to isolate a zone in a wellbore for said screen from said upper annulus and define a lower annulus;

defining a squeeze position for forcing fluid into the wellbore through said lower annulus, a circulate position where gravel is deposited in said lower annulus and returns come through said screen and past said packer to said upper annulus and a reverse position where gravel in said inner string assembly above said crossover can be reversed out to the surface, by relative movement of at least a portion of said inner string assembly with respect to said packer;

providing, as a part of said inner string assembly, a wash pipe with an open wash pipe valve adjacent a lower end of said inner string assembly;

isolating said upper annulus from said lower annulus in said reverse position with without closing said wash pipe valve.

2. The method of claim 1, comprising:

lifting said crossover above said packer to isolate fluid in said running string from said lower annulus in said reverse position.

3. The method of claim 2, comprising:

closing said upper annulus to said inner string assembly above said packer with a ported valve assembly.

4. The method of claim 3, comprising:

operating said ported valve assembly between an open and a closed position without moving said wash pipe valve.

5. The method of claim 4, comprising:

landing a reciprocating set down device on a shoulder on said outer assembly to support said inner string assembly including a housing of said ported valve assembly;

manipulating, with said running string, a sleeve assembly located within said housing of said ported valve assembly relatively to said now stationary housing of said ported valve assembly to selectively open or close a passage through said housing.

6. The method of claim 5, comprising:

using sequential pickup and set down movements of said running string to selectively open and close said passage.

7. The method of claim 6, comprising:

landing said sleeve assembly at different positions with respect to said housing with cycles of picking up and setting down said running string.

8. The method of claim 7, comprising:

using a j-slot assembly between said housing and said sleeve assembly to determine the landing position of said sleeve assembly with respect to said housing on successive cycles of picking up and setting down said running string.

9. The method of claim 8, comprising:

providing a port on said housing located uphole of an external seal on said housing to seal against said packer;

providing a sleeve assembly seal on an exterior surface of said sleeve assembly that is selectively positioned on opposed sides of said housing port.

10. The method of claim 9, comprising:

disposing said sleeve assembly seal in a passage between said sleeve assembly and said housing;

communicating said housing port with said upper annulus;

communicating said passage to said lower annulus.

11. The method of claim 10, comprising:

blocking said passage when said sleeve assembly seal is below said housing port;

opening said passage when said sleeve assembly seal is above said housing port.

12. The method of claim 11, comprising:

raising said sleeve assembly to lift said inner string assembly when said inner string assembly is in said circulate position to a location where said crossover is above said packer;

thereafter setting down on said running string to land said reciprocating set down device on said shoulder in said outer assembly and to move said sleeve assembly seal below said housing opening to isolate said upper annulus.

13. The method of claim 1, comprising:

requiring more than a force applied to said wash pipe valve in a single direction to close said wash pipe valve.

14. The method of claim 13, comprising:

moving said wash pipe valve in two opposed directions before said wash pipe valve can close.

15. The method of claim 14, comprising:

moving said wash pipe valve in three discrete movements with one of said movements in an opposite direction than the other two movements before it will close.

16. The method of claim 13, comprising:

pulling said wash pipe valve through a spaced apart end of a restricted bore in said outer assembly before said wash pipe valve can close.

17. The method of claim 13, comprising:

encountering resistance to an initial movement of said wash pipe valve as said wash pipe valve reaches a restricted bore in said outer assembly.

18. The method of claim 17, comprising:

overcoming said resistance with a force at a first predetermined level applied through said running string to said wash pipe valve.

19. The method of claim 18, comprising:

overcoming said resistance with a force at a second predetermined level higher than said first predetermined level if said wash pipe valve fails to advance through said restricted bore when said first predetermined level of force is applied.

20. The method of claim 16, comprising:

pushing said valve assembly fully through said restricted bore after said pulling said valve assembly fully through the same bore before said valve assembly can close.

21. The method of claim 20, comprising:

pulling said valve assembly at least in part into said restricted bore after said pushing said valve assembly through said restricted bore before said valve assembly can close.

* * * * *